US010159864B2

(12) United States Patent
Goldwitz

(10) Patent No.: US 10,159,864 B2
(45) Date of Patent: Dec. 25, 2018

(54) FOLDABLE TRAMPOLINE WITH AN ADJUSTABLE TENSION SYSTEM

(71) Applicant: Brian Goldwitz, New Haven, CT (US)

(72) Inventor: Brian Goldwitz, New Haven, CT (US)

(73) Assignee: SHELTERIT, LLC, Waterbury, CT (US)

( * ) Notice: Subject to any disclaimer, the term of this patent is extended or adjusted under 35 U.S.C. 154(b) by 9 days.

(21) Appl. No.: 15/051,639

(22) Filed: Feb. 23, 2016

(65) Prior Publication Data

US 2017/0239503 A1 Aug. 24, 2017

(51) Int. Cl.
*A63B 5/11* (2006.01)
*A63B 71/00* (2006.01)

(52) U.S. Cl.
CPC ..... *A63B 5/11* (2013.01); *A63B 71/0054* (2013.01); *A63B 2210/50* (2013.01); *A63B 2225/09* (2013.01)

(58) Field of Classification Search
CPC ... A63B 5/11; A63B 71/0054; A63B 2210/50; A63B 2225/09
USPC ..... 482/28
See application file for complete search history.

(56) References Cited

U.S. PATENT DOCUMENTS 2,533,520 A * 12/1950 Shimp ..... A62B 1/22 182/139
3,391,635 A * 7/1968 Matheus ..... B41F 15/36 101/127.1
4,139,192 A * 2/1979 McNeil ..... A63B 5/11 403/293
5,113,611 A * 5/1992 Rosson ..... B41F 15/36 101/127.1
5,711,743 A 1/1998 Nichols, Jr. et al.
5,788,606 A 8/1998 Rich
6,110,074 A * 8/2000 Tacquet ..... A63B 5/11 482/27
6,648,799 B2 * 11/2003 Hall ..... A63B 5/11 482/148
7,494,444 B2 * 2/2009 Adams ..... A63B 5/11 482/23
7,862,479 B2 1/2011 Goldwitz
2004/0071496 A1 4/2004 Chun Yueh
(Continued)

FOREIGN PATENT DOCUMENTS

CN 201832323 U 5/2011
NL 8702095 A 4/1989
(Continued)

OTHER PUBLICATIONS

International Search Report & Written Opinion for PCT/US 2017/019195 dated Aug. 3, 2017; 8 pages.

*Primary Examiner* — Andrew S Lo
(74) *Attorney, Agent, or Firm* — Loza & Loza, LLP; Jessica W. Smith

(57) ABSTRACT

A foldable or non-foldable trampoline includes a frame assembly that supports a resilient trampoline mat using a plurality of springs. The frame assembly includes an adjustable tension system that adjusts a dimension of the frame assembly. For a circular frame assembly, the adjustable tension system may increase the circumference of the frame assembly to increase a tension of the springs. The adjustable tension system may also decrease the circumference of the circular frame assembly to decrease a tension of the springs.

20 Claims, 23 Drawing Sheets

(56) References Cited

U.S. PATENT DOCUMENTS

| | | | | |
|---|---|---|---|---|
| 2006/0116242 | A1 | 6/2006 | Publicover | |
| 2010/0022355 | A1* | 1/2010 | Goldwitz | A47B 3/002 482/27 |
| 2011/0021321 | A1 | 1/2011 | Legg | |
| 2013/0045837 | A1 | 2/2013 | Hsiang | |
| 2015/0040959 | A1 | 2/2015 | Andon | |
| 2015/0051049 | A1* | 2/2015 | Andon | A63B 5/11 482/29 |

FOREIGN PATENT DOCUMENTS

| | | | |
|---|---|---|---|
| WO | 2006/055885 | A1 | 5/2006 |
| WO | 2010/012006 | A2 | 1/2010 |
| WO | 2015/170181 | A2 | 11/2015 |

* cited by examiner

FOLDABLE TRAMPOLINE WITH AN ADJUSTABLE TENSION SYSTEM

FIELD

This application relates to adjusting tension of a plurality of springs on a frame assembly of a trampoline and to a system and method for a folding trampoline with an adjustable tension system.

BACKGROUND

A typical trampoline includes a trampoline mat, a trampoline frame, and a plurality of springs in tension that secure the trampoline mat to the trampoline frame. In general, when a trampoline is in use for a prolonged time, the plurality of springs will gradually stretch or inelastically deform, and the trampoline bed will not provide the same tautness. With most current designs, the springs of the trampoline must be replaced to adjust the spring tension. Thus, it would be advantageous to have a mechanism to increase the tension of the springs due to inelastic deformation over time.

Additionally, or alternatively, it may be desired to adjust the tension of the springs for different weights of users and/or to adjust a tautness of the trampoline mat. For example, a user may desire to adjust a tautness of a trampoline to decrease deflection of the trampoline mat. Thus, there is a need for a trampoline in which the tension of the springs, and as such the tautness of the trampoline bed, may be easily adjustable.

In addition, trampolines are commonly used in yards by consumers for a variety of athletic and recreational purposes. However, trampolines are often difficult to move or to store when needed due to their large size and bulky shape. Assembling and disassembling a trampoline for movement or storage can be time consuming and may even lead to injuries especially when tension is still present in the springs around the trampoline bed and frame. Thus, there is a need for a foldable trampoline that may be moved and stored easily and safely.

SUMMARY

According to a first aspect, a trampoline comprises a trampoline mat; a plurality of springs attached to the trampoline mat; and a frame assembly configured to support the trampoline mat using the plurality of springs, wherein the frame assembly includes an adjustable tension system configured to adjust a circumference of the frame assembly. The adjustable tension system comprises a first connecting member; and a second connecting member moveably attached to the second connecting member. The first connecting member is configured to slidably move in a first direction with respect to the second connecting member to increase the circumference of the frame assembly and increase a tension in the plurality of springs. In addition, the first connecting member is configured to slidably move in a second direction with respect to the second connecting member to decrease the circumference of the frame assembly and decrease a tension in the plurality of springs.

According to a second aspect, a foldable trampoline comprises a trampoline mat; a plurality of springs attached to the trampoline mat; and a frame assembly attached to the plurality of springs. The frame assembly includes a first base member and a second base member; an adjustable tension system configured to adjust a tension in the plurality of springs; a first side including at least a first peripheral frame member pivotably connected to the first base frame member and the second base member; and a second side including at least a second peripheral frame member pivotably connected to the first base frame member and the second base member. When the adjustable tension system reduces spring tension, the first side and the second side are configured to pivot into a substantially perpendicular position with respect to the first and second base frame members. The frame assembly may comprise a plurality of side pivoting joints configured to pivot the at least first peripheral frame member on the first side and the at least second peripheral frame member on the second side of the trampoline into the substantially perpendicular position with respect to the first and second base frame members.

According to a third aspect, the foldable trampoline further includes a plurality of net support members configured to support a safety net and a plurality of pivot joints, wherein each of the pivot joints is configured to rotatably attach one of the plurality of net support members with respect to the frame assembly. The foldable trampoline further comprises a plurality of leg support members pivotally connected to the frame assembly by a plurality of leg pivot joints.

DETAILED DESCRIPTION

Figure 1:
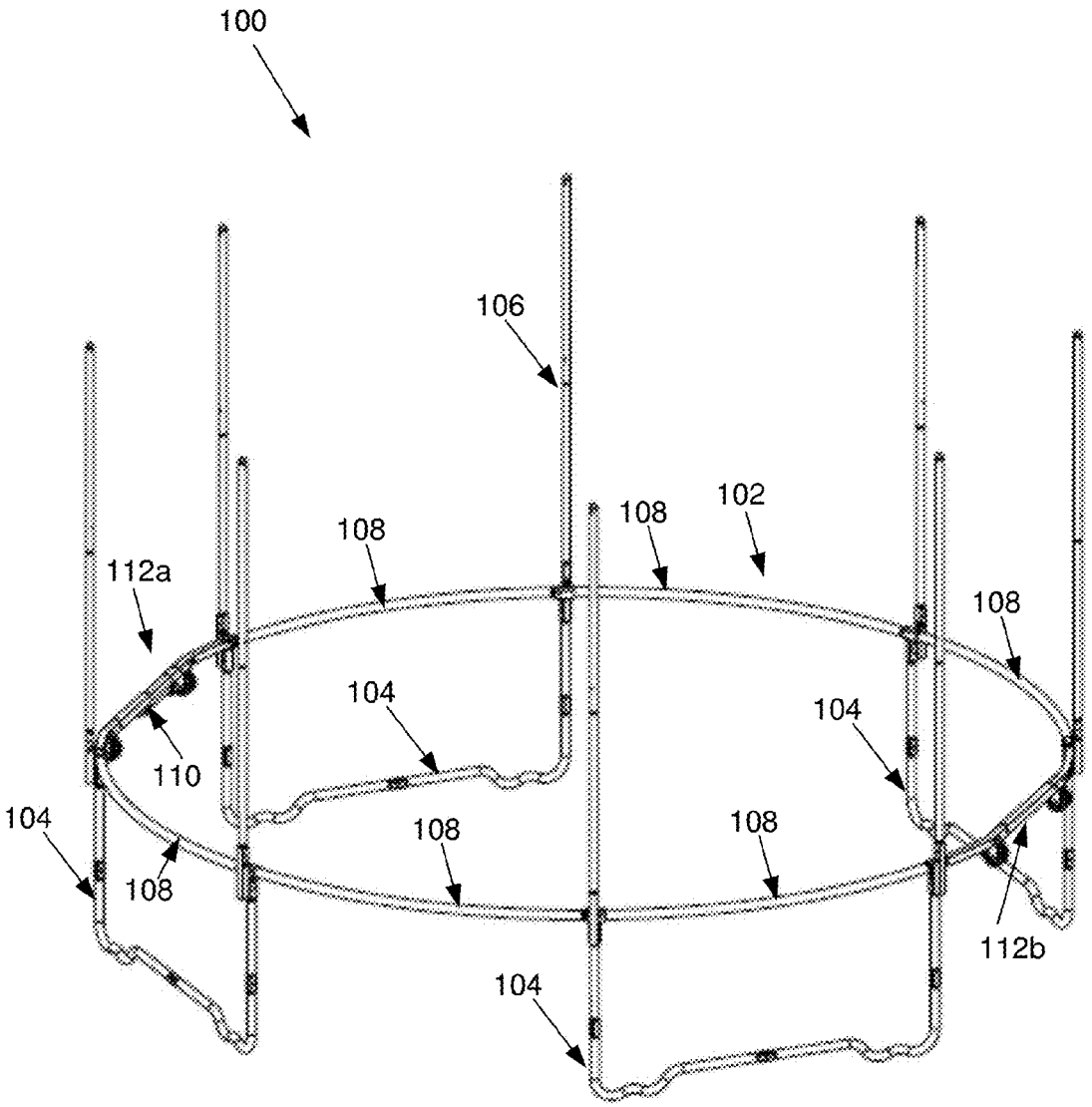
FIG. 1 illustrates a perspective view of an exemplary embodiment of a trampoline with an adjustable tension system.

The word "exemplary" or "embodiment" is used herein to mean "serving as an example, instance, or illustration." Any implementation or aspect described herein as "exemplary" or as an "embodiment" is not necessarily to be construed as preferred or advantageous over other aspects of the disclosure. Likewise, the term "aspects" does not require that all aspects of the disclosure include the discussed feature, advantage, or mode of operation.

Embodiments will now be described in detail with reference to the accompanying drawings. In the following description, numerous specific details are set forth in order to provide a thorough understanding of the aspects described herein. It will be apparent, however, to one skilled in the art, that these and other aspects may be practiced without some or all of these specific details. In addition, well known steps in a method of a process may be omitted from flow diagrams presented herein in order not to obscure the aspects of the disclosure. Similarly, well known components in a device may be omitted from figures and descriptions thereof presented herein in order not to obscure the aspects of the disclosure.

Overview

In a first exemplary embodiment, a foldable or non-foldable trampoline includes a frame assembly that supports a resilient trampoline mat using a plurality of springs in tension. The frame assembly includes an adjustable tension system configured to adjust at least one dimension of the frame assembly to thereby adjust the tension in the plurality of springs. For example, when the frame assembly is circularly shaped, the adjustable tension system adjusts a circumference of the frame assembly. As the circumference is increased, the tension of the springs increases, and so the tautness of the trampoline mat, is increased. When the circumference is decreased, the tension of the springs is decreased, and so the tautness of the trampoline mat, is decreased. The tautness of the trampoline mat may thus be adjusted for a user's preference or to compensate for inelastic deformation of worn springs.

In a second exemplary embodiment, a trampoline includes a foldable frame assembly that is supported by a plurality of supporting members to elevate the frame assembly from a horizontal surface. The frame assembly supports a resilient trampoline mat using a plurality of springs in tension. An adjustable tension system decreases the circumference of the frame assembly to thereby decrease the tension of the springs. With the decrease in tension from the springs, the frame assembly is more easily foldable from an expanded state to a collapsed state. The frame assembly includes two base frame members and two or more peripheral frame members connected between the two base frame members by pivoting joints. The pivoting joints are configured to pivot or fold the peripheral frame members on a first side and a second side into a vertical position. In this folded state, the first side and the second side move from a parallel position to a substantially perpendicular position with respect to the base members. Thus, a first side of the trampoline and a second side of the trampoline fold inwards into a substantially perpendicular position with respect to the base members. The base members support the trampoline in this collapsed state using one or more wheeled supports or other type of leg supports. In the collapsed state, the supporting members of the trampoline may be folded inwards as well.

Adjustable Tension System

FIG. 1 illustrates a perspective view of an exemplary embodiment of a trampoline 100 with an adjustable tension system 110. The trampoline 100 generally includes a frame assembly 102 supported by a plurality of supporting members 104 configured to elevate the frame assembly 102 from a horizontal surface. In one aspect, the supporting members 104 are U-shaped including a substantially horizontal bar and at least two vertical bars attached thereto and to the frame assembly 102. The frame assembly 102 supports a resilient trampoline mat using a plurality of springs (not shown in FIG. 1). The springs may include any type of resilient devices or materials, such as metal coils, bungie cords, etc. Such trampoline mat may be used as a jumping surface.

The trampoline 100 may also include a safety net (not shown) supported by a plurality of net support members 106. The net support members 106 are attached to the frame assembly 102 or to the plurality of supporting members 104. The net support members 106 may be attached to the frame assembly 102 in approximately a same position as the plurality of supporting members 104. In another aspect, the net support members 106 may be attached in other positions around the frame assembly 102.

The frame assembly 102 of the trampoline 100 includes a plurality of peripheral frame members 108 connected between two base frame members 112. In an embodiment, the frame assembly 102 includes one or more adjustable tension systems 110. The adjustable tension system 110 is shown in FIG. 1 as included within base member 112*a* though the adjustable tension system 110 may also be included within both base members 112*a* and 112*b*. In another embodiment, the adjustable tension system 110 may be included as part of one or more of the peripheral frame members 108.

In an embodiment, the adjustable tension system 110 is configured to adjust at least one dimension of the frame assembly 102 to thereby adjust the tension in the plurality of springs. For example, when the frame assembly is circularly shaped, the adjustable tension system 110 adjusts the circumference of the frame assembly. When the circumference is increased, the tension of the springs, and so the tautness of the trampoline mat, is increased. When the circumference is decreased, the tension of the springs is decreased, and so the tautness of the trampoline mat, is decreased. The tautness of the trampoline mat may thus be adjusted for a user's preference or to compensate for inelastic deformation of worn springs by adjusting a circumference of the frame assembly.

Figure 2A:
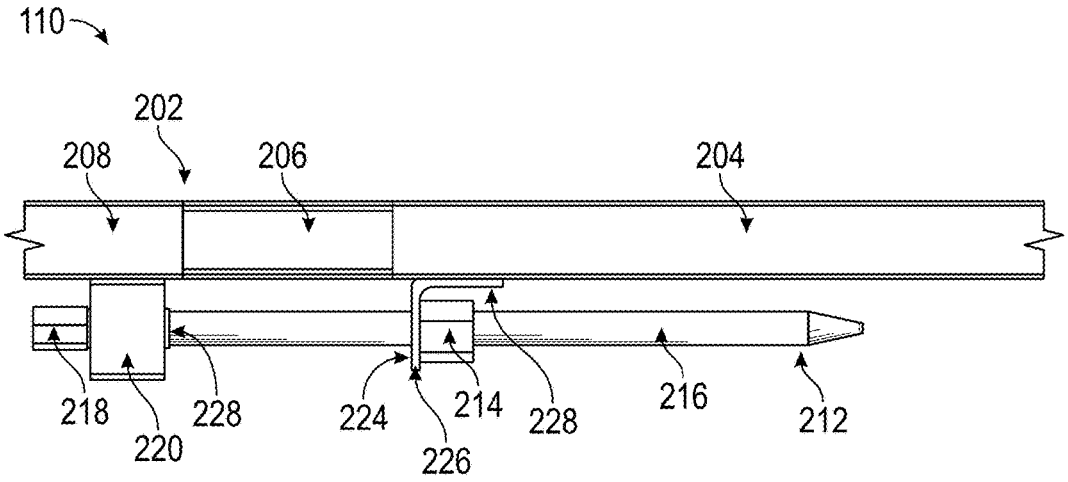
FIG. 2A illustrates a side view of an exemplary embodiment of the adjustable tension system.

FIG. 2A illustrates a side view of an exemplary embodiment of the adjustable tension system 110. The adjustable tension system 110 includes a first connecting member 202 moveably attached to a second connecting member 204. In one aspect, the first connecting member 202 includes a first external portion 208 and a second adjustable portion 206, wherein the external portion 208 has a greater circumference than the adjustable portion 206. For example, the first connecting member 202 may have a substantially square profile with the external portion 208 having sides of length l while the adjustable portion 206 has sides having a length less than the value l. In another embodiment, the frame assembly 102 may have frame members with a circular profile. In this instance, the external portion 208 of the first connecting member 202 has a diameter d and the adjustable portion 206 of the first connecting member 202 has a diameter less than d. Though a square and circular profile have been explicitly described, the frame assembly 102 may include first and second connecting members 202, 204 with other profiles and geometric shapes as well, such as rectangular, triangular or oval.

The second connecting frame member 204 of the adjustable tension system 110 is configured for receiving the adjustable portion 206. For example, the second connecting frame member 204 preferably has a same profile or geometric shape as the adjustable portion 206 and has a circumference greater than the adjustable portion 206. As such, the adjustable portion 206 is configured to slide within the second connecting frame member 204. In an embodiment, the second connecting frame member 204 has a same or substantially same circumference as the external portion 208.

In an embodiment, the adjustable portion 206 slidably moves with respect to the second connecting frame member 204 to adjust the circumference of the trampoline 100. For example, the adjustable portion 206 slides in a first direction towards or further into or along the second connecting frame member to decrease an effective length $l_e$ of the adjustable portion 206. By decreasing the effective length $l_e$, the circumference of the entire frame assembly 102 of the trampoline 100 is decreased. This decrease in circumference decreases the tension on the plurality of springs between the frame assembly 102 and the trampoline mat.

In another example, the adjustable portion 206 slides in a second direction extending further from the second connecting frame member to increase an effective length $l_e$ of the adjustable portion 206. By increasing the effective length $l_e$, the circumference of the entire frame assembly 102 of the trampoline 100 is increased. This increase in circumference increases the tension on the plurality of springs between the frame assembly and the trampoline mat.

In an embodiment, to slidably attach the first connecting member 202 and the second connecting member 204, the adjustable tension system 110 includes a bolt and nut assembly. A first end of a bolt 212 includes an externally threaded portion 216 onto which a nut 214 is threadably fastened. A connecting structure 224 includes a first side 226 having an aperture through which the bolt 212 is threadably attached. A second side 228 of the connecting structure 224 is positioned at a right angle with respect to the first side 226 and is fixedly attached to the second connecting member 204. The nut 214 is fixedly attached, e.g. welded, to the connecting structure 224. At a second end of the bolt, a bolt head structure 220 is fixedly attached to the external portion 208 of the first connecting member 202. The bolt head structure 220 rotatably secures the bolt 212 to the external portion 208 between an adjusting nut 218 and a securing nut 228.

When a rotational force is applied to the adjusting nut 218 in a first direction, the bolt 212 moves along the threads of the nut 214 and the second connecting member 204 slides towards the first connecting member 202. The adjustable portion 206 slides further into the second connecting member 204 and decreases the effective length $l_e$ and so the circumference of the trampoline 100. The tension of the plurality of springs is decreased with the decrease in the effective length $l_e$ and the circumference. When a rotational force is applied to the adjusting nut 218 in a second direction and the bolt 212 moves along the threads of the nut 214, the second connecting member 204 slides further from the first connecting member 202, and the effective length $l_e$ of the adjustable portion 206 increases. This increase in the effective length $l_e$ increases the circumference of the frame assembly 102 and increases the tension in the plurality of springs.

Figure 2B:
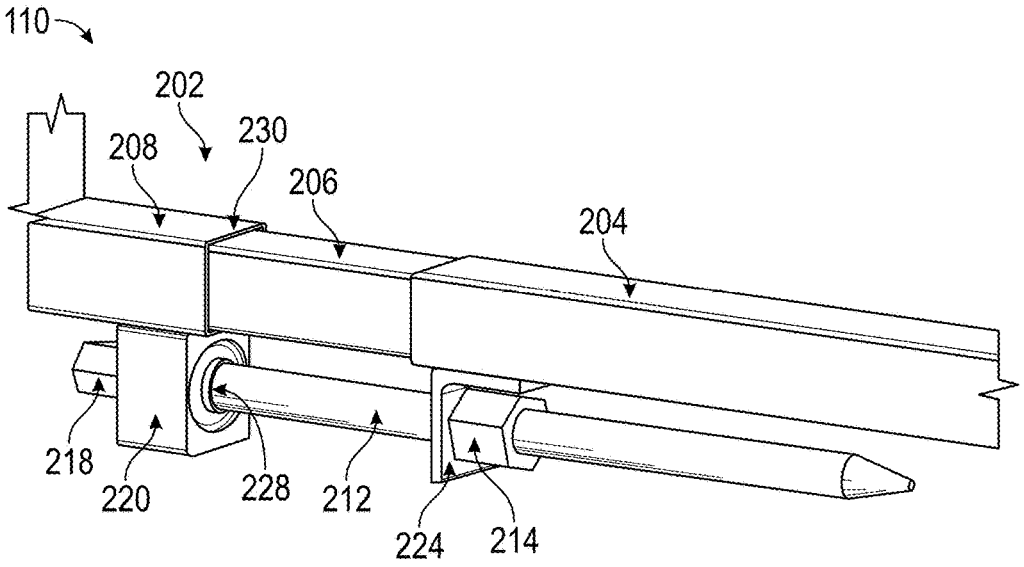
FIG. 2B illustrates an elevational view of an exemplary embodiment of the adjustable tension system.

FIG. 2B illustrates an elevational view of an exemplary embodiment of the adjustable tension system 110. The external portion 208 of the first connecting member 202 has a greater circumference than the adjustable portion 206 and preferably a same or greater circumference than the second connecting member 204. The second connecting member 204 is thus prevented from slidably moving when it engages the juncture 230 between the external portion 208 and the adjustable portion 206.

In the embodiments shown in FIGS. 2A and 2B, the adjustable tension system 110 includes a bolt and nut assembly to slidably attach the first connecting member 202 and the second connecting member 204. In other embodiments, alternative mechanisms may be used to movably attach the first connecting member 202 and the second connecting member 204. For example, in one aspect, the adjustable portion 206 may comprise a bolt with threads on one or more ends that threadably attaches or screws into hollow threaded ends of the first connecting member 202 and/or the second connecting member 204. Rotation of the adjustable portion 206 to further thread the adjustable portion 206 into or out of the threaded hollow ends of the first connecting member 202 and/or the second connecting member 204 would then adjust its length.

Figure 13A:
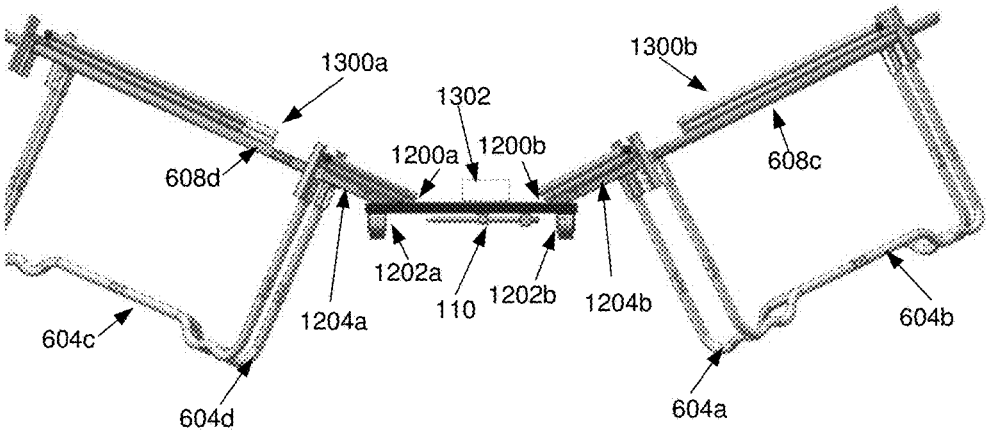
FIG. 13A illustrates an elevational view of an embodiment of the frame assembly of the foldable trampoline in another partially folded state.

In another aspect, a mechanism 1302 shown in FIG. 13A such as a pump assembly may be implemented to adjust a length of the adjustable portion 206. For example, a hydraulic jack, such as a side mounted bottle hydraulic jack, or pneumatic air cylinder may be implemented to move the first connecting member 202 with respect to the second connecting member 204. In another embodiment, a cantilever assembly may be implemented or a gear assembly with a track and wheel that may be turned to move the first connecting member 202 with respect to the second connecting member 204. For example, a crank may be implemented to move the gear assembly such that the first connecting member 202 moves with respect to the second connecting member 204. These or other mechanisms may be implemented to adjust the effective length of the frame assembly 102.

Figure 3:
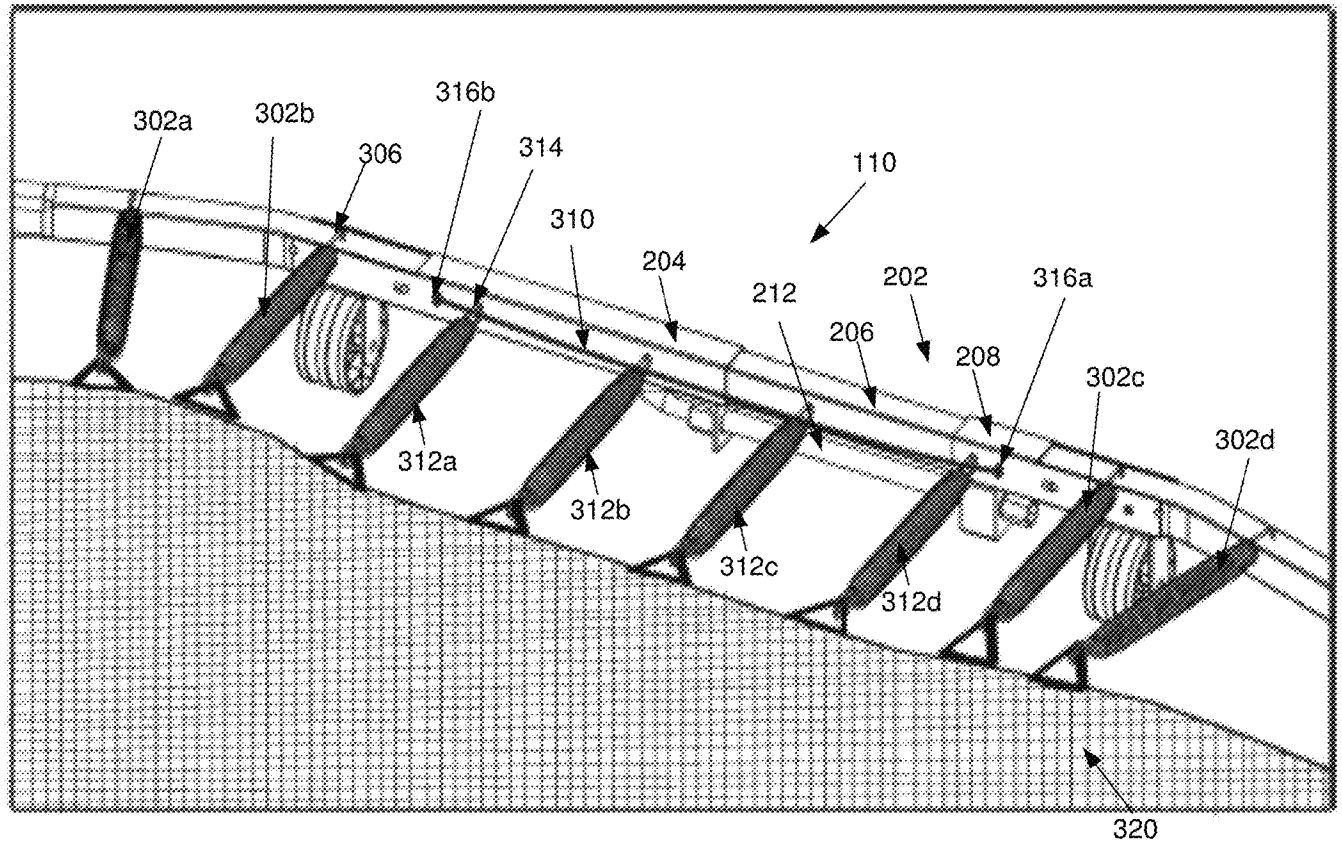
FIG. 3 illustrates an elevational view of another exemplary embodiment of the adjustable tension system.

FIG. 3 illustrates an elevational view of another exemplary embodiment of the adjustable tension system 110 implemented as part of a base member 112. The frame assembly 102 supports a resilient trampoline mat 320 using a plurality of springs 302, 312. The springs 302, 312 may comprise any type of resilient devices or materials, such as metal coils, bungie cords, etc. A first set of the plurality of springs 302*a*, 302*b*, 302*c*, 302*d* are fixedly attached to the frame assembly 102 using, e.g. a fastening hook structure 306 or other fastening mechanism.

In one aspect, a second set of the plurality of springs 312*a*, 312*b*, 312*c*, 312*d* are attached to the trampoline mat 320 at positions near or across from the adjustable tension system 110. The second set of springs 312 are attached to a cable 310 using a clasp mechanism 314 or other fastening mechanism. A first end 316*a* of the cable 310 is attached to the first connecting member 202, and a second end 316*b* of the cable 310 is attached to the second connecting member 204. In another aspect, only the one or more springs, such as spring 312*c*, adjacent to the adjustable portion 206 are attached to the cable 310.

The cable 310 is configured to adjust its length to compensate for adjustments in the effective length $l_e$ of the adjustable tension system 110. For example, the cable 310 may include an elastic material that stretches or relaxes in response to increases or decreases in the effective length $l_e$ of the adjustable tension system 110. In another embodiment, the length of the cable 310 may be automatically increased or decreased in response to increases or decreases in the effective length $l_e$ of the adjustable tension system 110.

Figure 4:
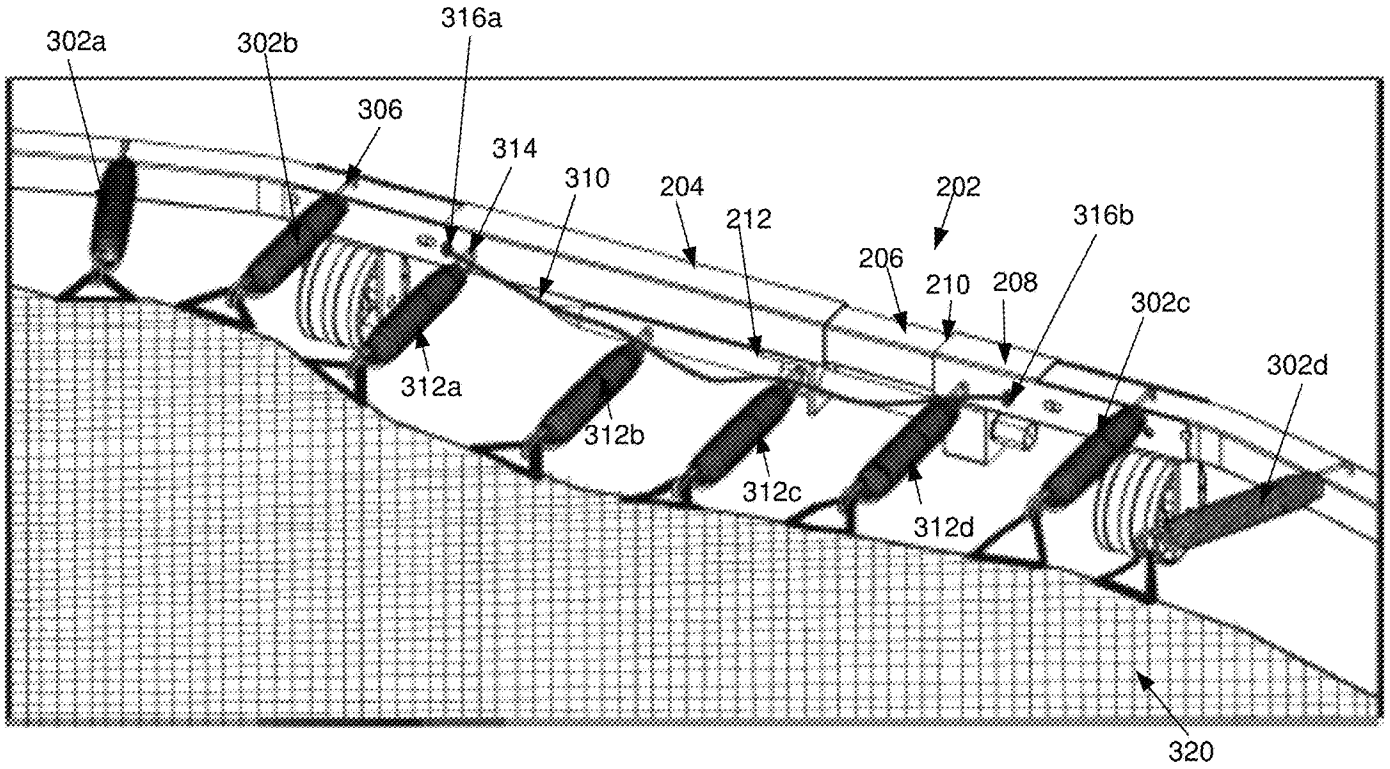
FIG. 4 illustrates an elevational view of another exemplary embodiment of the adjustable tension system with a plurality of springs in a relaxed state.

FIG. 4 illustrates an elevational view of an exemplary embodiment of the adjustable tension system 110 with the plurality of springs 302, 312 in a relaxed state. In this embodiment, the effective length $l_e$ of the adjustable portion 208 has been decreased such that the first set of springs 302*a*, 302*b*, 302*c*, 302*d* are in an unstretched, resting state. At this effective length $l_e$, the cable 310 is lax and no longer in tension such that the second set of springs 312*a*, 312*b*, 312*c*, 312*d* are also in an unstretched, resting state.

In another embodiment, the one or more springs, such as spring 312*c*, positioned on the adjustable portion 206 is attached to a ring (not shown) or bracket (not shown) that is movably attached around the adjustable portion 206. A mechanism is used to slide the ring or bracket to adjust the position of the spring 312*c* to compensate for the adjustment in the length of the adjustable portion 206. For example, as the adjustable portion 206 decreases in length, the second connecting member 204 may engage the ring or bracket and push the ring or bracket closer to the junction 210. A cable (not shown) attached to the second connecting member 204 may pull the ring or bracket (not shown) away from the junction 210 when the adjustable portion 206 increases in length as the connecting member 204 slides away from the junction 210.

Figure 5A:
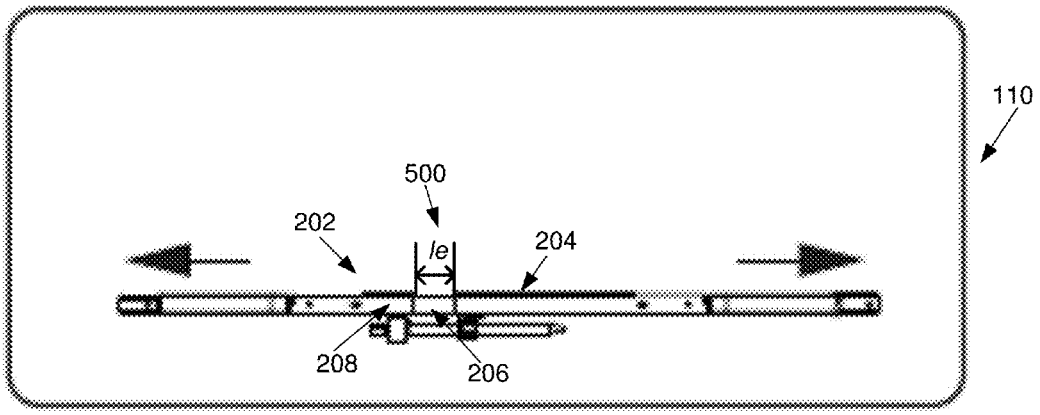
FIG. 5A illustrates a side view of an embodiment of the adjustable tension system and the adjustable effective length.

FIG. 5A illustrates a side view of an embodiment of the adjustable tension system and the adjustable effective length $l_e$ 500. As the first connecting member 202 slides with respect to the second connecting member 204, the effective length $l_e$ of the adjustable tension system 110 may be adjusted. The spring tension of the plurality of springs attached to the frame assembly 102 and the trampoline mat 320 is adjusted in response to a change in the effective length $l_e$. In an embodiment, it is desirable to determine the change in effective length $l_e$ needed to obtain a relaxed state of the plurality of springs or obtain a certain tension setting.

Figure 5B:
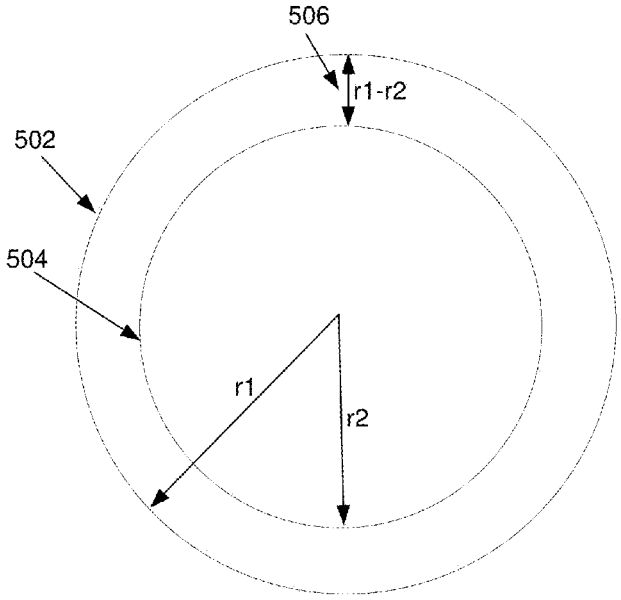
FIG. 5B illustrates a schematic block diagram of an embodiment showing a change in circumference of a trampoline due to the adjustable tension system.

FIG. 5B illustrates a schematic block diagram of an embodiment showing a change in circumference from the adjustable tension system 110. Referring to FIG. 5B, in an embodiment, the circumference $C_1$ 502 of the frame assembly 102 at a first state is equal to $C_1=2\pi r_1$. After decreasing the effective length $l_e$ of the adjustable tension system 110, the circumference $C_2$ 504 of the frame assembly 102 is decreased and equals $C_2=2\pi r_2$. This decrease in the circumferences C1-C2 is equal to the decrease in the effective length $l_e$ of the adjustable tension system 110. The change in the stretch or length of any of the plurality of springs $S_l$ is equal to $S_l=r_1-r_2$. So a change in the effective length $l_e$ needed to relax or stretch the length of a spring by $S_l$ may be determined by:

Change in the effective length $l_e=2\pi S_l$, wherein $S_l$ is the desired change in the length of the spring For example, when the plurality of springs are stretched 2 cm between the trampoline mat 320 and the frame assembly 102 from their resting or unstretched state, the effective length $l_e$ of the adjustable tension system 110 must be decreased by $4\pi$ cm to return the springs to their resting state. In another example, to increase the tautness of the trampoline mat 320, the effective length $l_e$ of the adjustable tension system 110 must be increased to effect a certain change in the stretch or length of the plurality of springs $S_l$. In an embodiment, the adjustable portion 206 may be marked to indicate various tension levels to assist in adjusting the adjustable tension system 100 to achieve a desired tension of the springs or tautness of the trampoline mat 320.

In an embodiment, the adjustable tension system 110 is configured to adjust the circumference of the frame assembly 102. When the circumference is increased, the tension of the springs, and so the tautness of the trampoline mat, is increased. When the circumference is decreased, the tension of the springs is decreased, and so the tautness of the trampoline mat, is decreased. The tautness of the trampoline mat may thus be adjusted for a user's preference or to compensate for inelastic deformation of worn springs.

Figure 6:
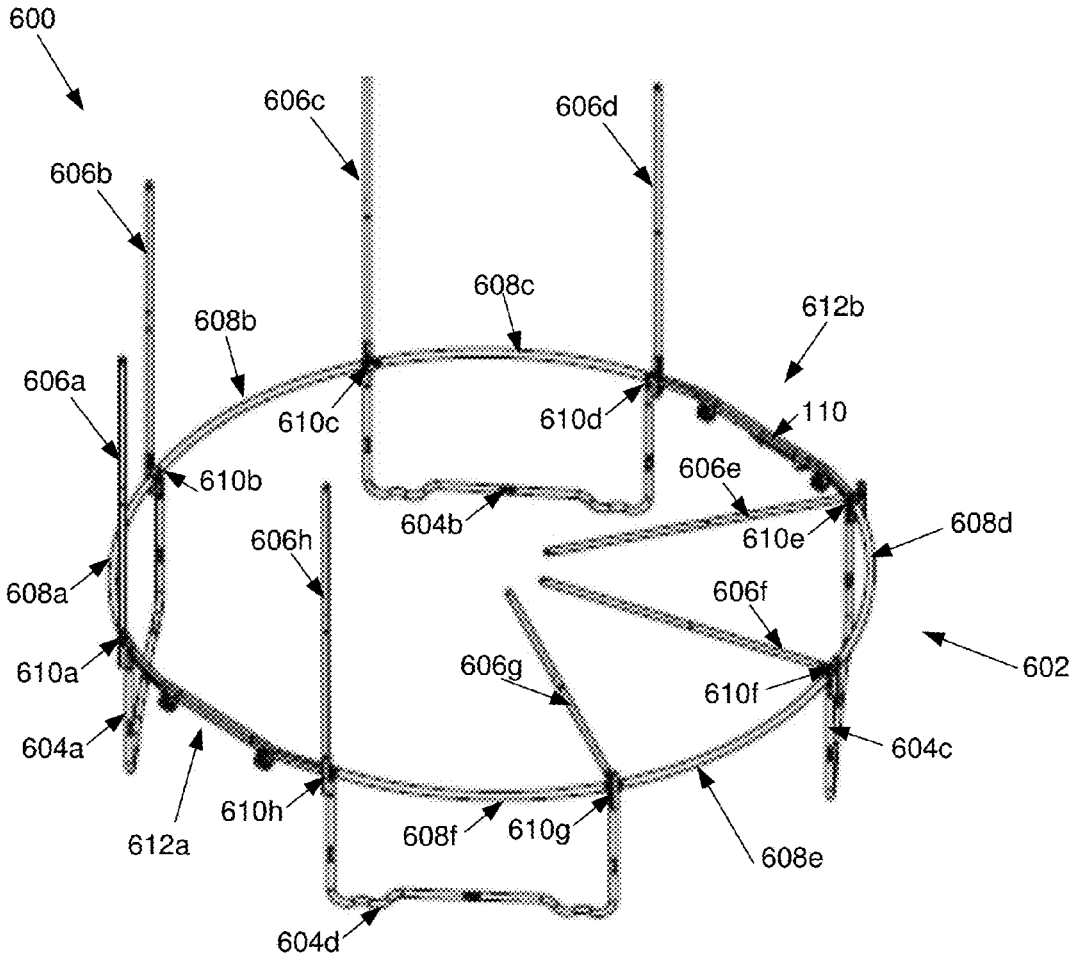
FIG. 6 illustrates an elevational view of an embodiment of a frame assembly of a foldable trampoline.

FIG. 6 illustrates an elevational view of an embodiment of a frame assembly 602 of a foldable trampoline 600. The frame assembly 602 includes a first base frame member 612*a*, a second base frame member 612*b* and a plurality of peripheral frame members 608*a-f*. In the embodiment shown in FIG. 6, the frame assembly 602 includes three peripheral frame members 608*a*, 608*b*, 608*c* connecting a first side of the first base member 612*a* and a first side of the second base frame member 612*b* and three other peripheral frame members 608*d*, 608*e* and 608*f* connecting a second side of the first base member 612*a* and a second side of the second base frame member 612*b*. Though three peripheral frame members 608 are illustrated, a different number of peripheral frame members 608, such as one, two or more than three, may be implemented to connect the first and second base members 612*a*, 612*b*. The foldable trampoline 600 further includes a plurality of leg support members 604*a-d* attached to the frame assembly 602.

The foldable trampoline 602 also includes an adjustable tension system 110 included within base member 612*b*. In another aspect, a first adjustable tension system 110 may be included within the first base member 612*a*, and a second adjustable tension system 110 may be included within the second base member 612*b*. In another embodiment, the adjustable tension system 110 may be included as part of one or more of the peripheral frame members 608. For example, the adjustable tension system 110 may be included within peripheral frame member 608*b* or within peripheral frame member 608*e* or within both peripheral frame members 608*b* and 608*e*. In another aspect, three, four or more adjustable tension systems 110 may be implemented in a combination of three, four or more of the plurality of the base members 612 and the plurality of peripheral frame members 608.

In addition, the foldable trampoline 600 includes a safety net (not shown) supported by a plurality of net support members 606*a-h*. The net support members 606*a-h* are pivotally attached to the frame assembly 602 and/or the plurality of leg supporting members 604 by respective pivot joints 610*a-h*. A pivot joint 610 is configured to allow a respective net support member 606 to pivot or fold over the frame assembly 602 inwards towards the center of the circumference of the frame assembly 602.

Pivot Joint

Figure 7:
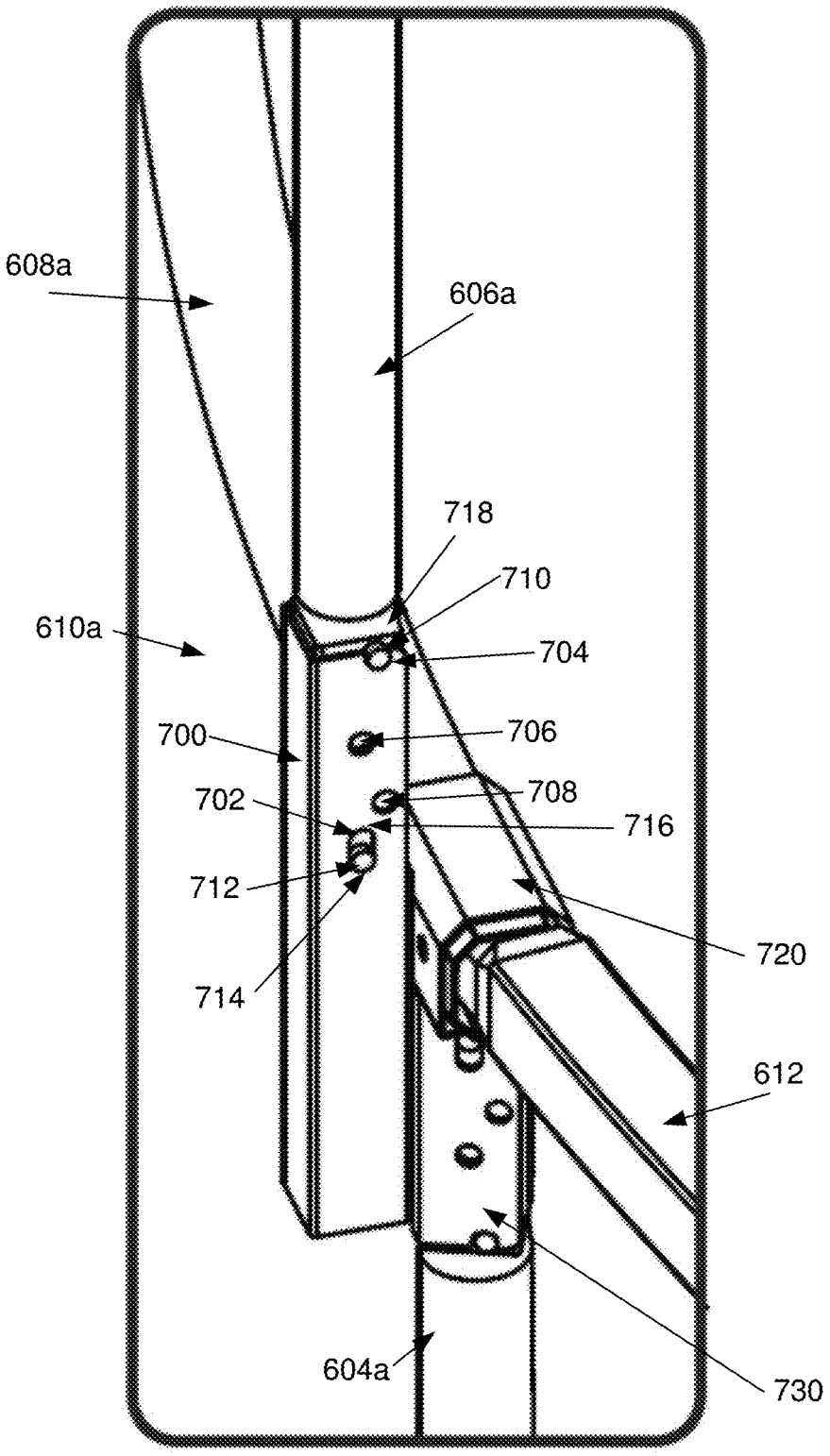
FIG. 7 illustrates an elevational view of an embodiment of a pivot joint.

FIG. 7 illustrates an elevational view of an embodiment of a pivot joint 610. In the example shown in FIG. 7, for illustrative purposes, the pivot joint 610*a* attached to the net support member 606*a* is shown with the understanding that the other pivot joints 610*b-h* have a similar corresponding structure.

The pivot joint 610*a* includes a bracket 700 fixedly attached to a connecting structure 720 between the base frame member 612 and the peripheral frame member 608*a* and near to or adjacent to the leg support member 604*a*. The bracket 700 may also be or alternatively fixedly attached to the leg support member 604*a*. In another aspect, the bracket 700 may be attached in another position around the frame assembly 102 than near to or adjacent to the leg support members 604.

The bracket 700 may by substantially hollow and may have a proximal end and a distal end. The proximal end may be enclosed while the distal end may be substantially open, i.e., the distal end may have an open face and adapted to receive a base structure 718 of the net support member 606*a*. In that respect, the bracket 700 and the base structure 718 should be approximately the same geometric shape (i.e., tubular, rectangular tubular, etc.).

The base structure 718 includes a securing protrusion 712 and a release protrusion 710 on a first side and similar structures on a second opposing side (not shown). The bracket 700 forms a securing aperture 702 and a release notch 704 on a first side and similar structures on a second opposing side (not shown). When the base structure 718 is in a securely installed state within the bracket 700 as shown in FIG. 7, the securing protrusion 712 is positioned on the base structure 718 to protrude from a lower end of the securing aperture 702, and the release protrusion 710 is positioned to securely fit within the release notch 710. The engagement of the release protrusion 710 with the release notch 704 prevents folding or pivoting by the base structure 718.

Though a release protrusion 710 and release notch 704 are implemented in this embodiment, other fastening mechanisms may be employed to secure the net support member 606*a* within the bracket 700. For example, the bracket 700 may alternatively or further include one or more other apertures 706, 708 for respectively receiving any one of numerous other fastening mechanisms, such as pins, clips, buttons, etc. These one or more other fastening mechanisms may be employed to provide alternative or additional safety measures to prevent unintentional folding of the net support member 606*a*.

In an embodiment, a leg pivot joint 730 similar in structure to the pivot joint 610*a* attaches the leg support member 604*a* to the frame assembly 602. The leg pivot joint 730 is positioned at an angle with respect to the connecting structure 720 between the base frame member 612 and the peripheral frame member 608*a*. For example, the bracket 700 is positioned at an approximately right angle with respect to the connecting structure 720 such that the net support member 606 fold approximately perpendicular to the connecting structure 720. In contrast, the two leg support members of the support member 604*a* need to fold inward as described in more detail herein. To accommodate the folding of both poles attaching the leg support members 604, the pivot joints 730 attaching the poles of a leg support member 604 are angled towards each other and at acute angles with their respective connecting structure 720.

Figure 8:
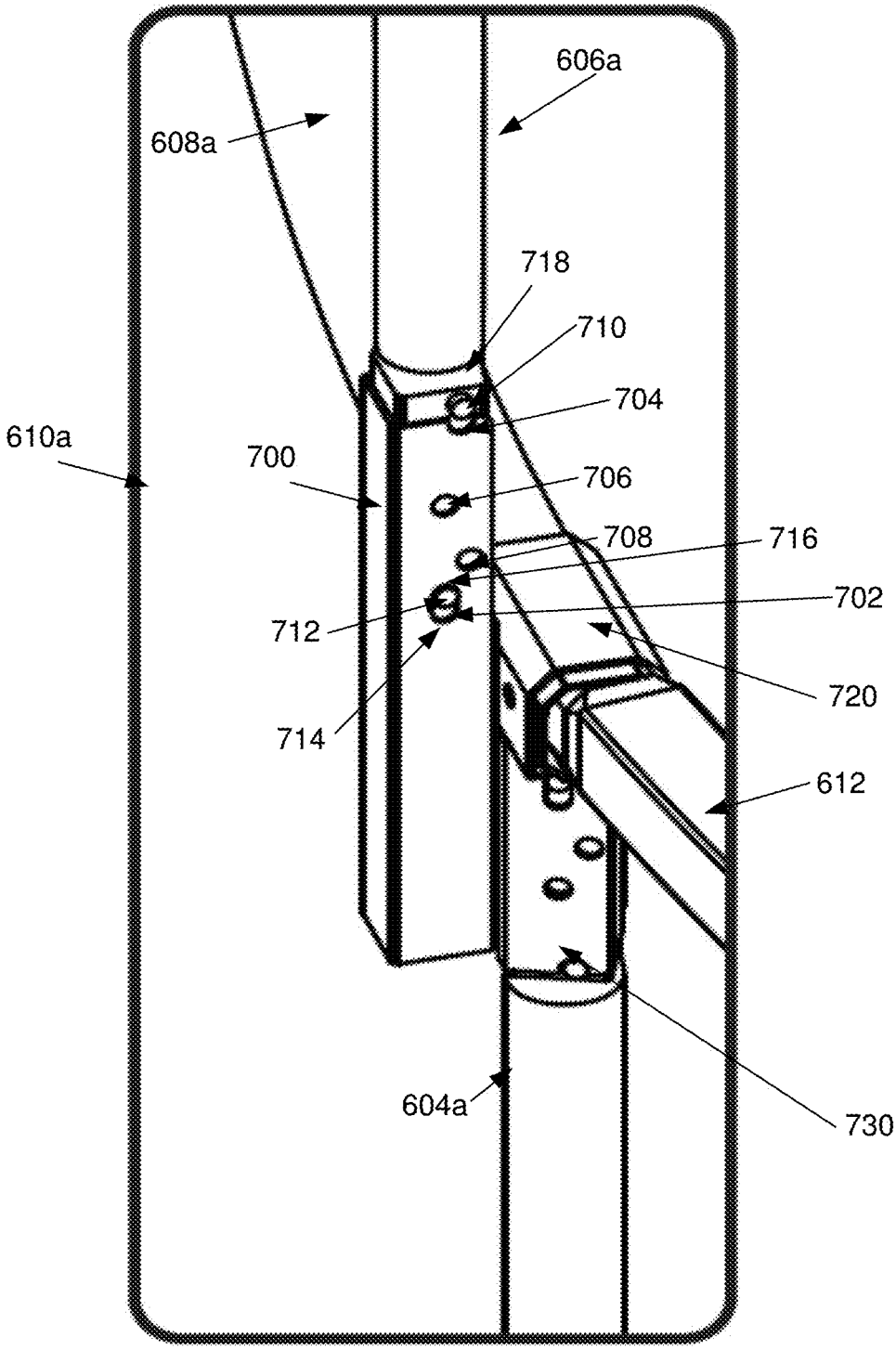
FIG. 8 illustrates an elevational view of an embodiment of the pivot joint in a partially released state.

FIG. 8 illustrates an elevational view of an embodiment of the pivot joint 610*a* in a partially released state. In an embodiment, the base structure 718 of the net support member 606*a* is configured to slide or move towards a top opening of the bracket 700 guided by the securing protrusion 712 within the securing aperture 702. The base structure 718 is operable to slide or move until the securing protrusion 712 engages an upper end 716 of the securing aperture 702 that halts further movement. The engagement of the securing protrusion 712 with the upper end 716 of the securing aperture 702 on the first side (and similarly with corresponding structures on the second opposing side of the bracket 700) prevents detachment of the net support member 606*a* from the bracket 700. However, the movement of the base structure 718 along the bracket 700 is sufficient to disengage the release protrusion 710 from the release notch 704. In an embodiment, the securing protrusion 712 has a length equal to or greater than a clearance length, wherein the clearance length is the distance that the base structure 710 must move to disengage the release protrusion 710 from the release notch 704. The clearance length is determined based on this distance that the net support member 606*a* must slide to disengage the release protrusion 710 from the release notch 704.

Figure 9:
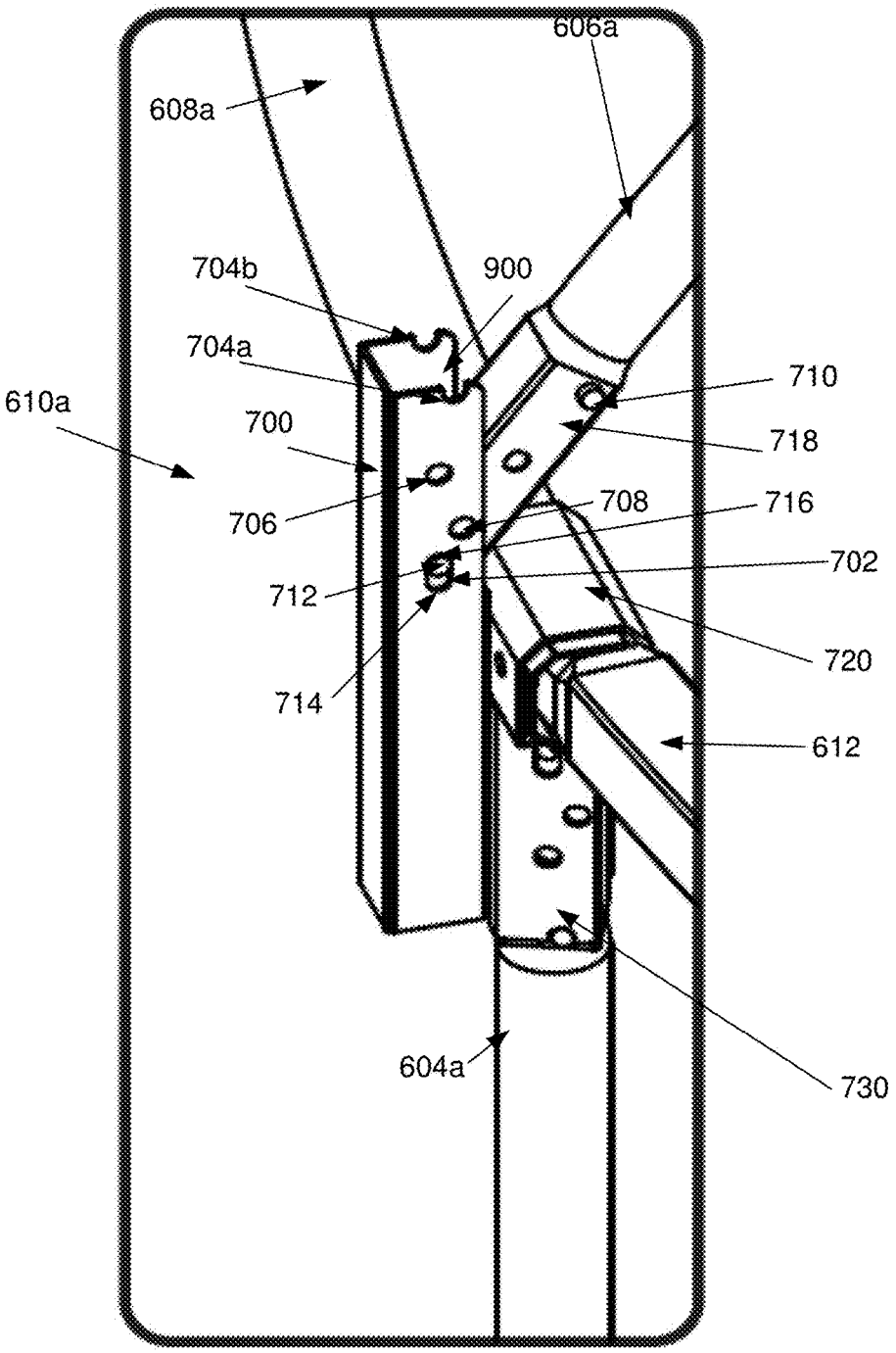
FIG. 9 illustrates an elevational view of an embodiment of the pivot joint with the net support member in a partially folded state.

FIG. 9 illustrates an elevational view of an embodiment of the pivot joint 610*a* with the net support member 606*a* in a partially folded state. The release protrusion 710 is disengaged from the release notch 704, and the securing protrusion 712 of the base structure 718 acts as a pivot within the securing aperture 702 while securing the base structure 718 within the bracket 700. The securing protrusion 712 is thus configured as a pivot on which the net support member 606*a* may swivel or pivot or fold through a top bracket opening 900 over the frame assembly 602.

As seen in FIG. 9, a similar release notch 704*b* is located on the second opposing side of the bracket 700 as well as a similar corresponding securing protrusion 712. Though a release protrusion 710 and release notch 704 are implemented in this embodiment, other fastening mechanisms may be employed to secure the net support member 606*a* within the bracket 700 and prevent unintentional folding of the net support member 606. Due to the force of gravity, the net support member 606 remains secure within the bracket 700 until an upward force is applied to disengage the release protrusion 710 from the release notch 704.

The pivot joint 610 thus enables folding or pivoting of the net support member 606 while maintaining attachment of the net support member 606 with the bracket 700. The net support members 606 thus remain secured to their respective brackets 700 in a folded position and do not need to be completely detached, disassembled or separated from the frame assembly 602 for folding or moving or storage of the trampoline 600. The pivot joints 610 thus provide a means for the net support members 606 to be more easily reassembled with less likelihood of a loss of components or an incorrect installation of components.

The pivot joints 610 may be implemented with other components or devices, such as foldable sports goals, folding table legs, or other types of support members, etc.

Trampoline Folding System

Figure 10:
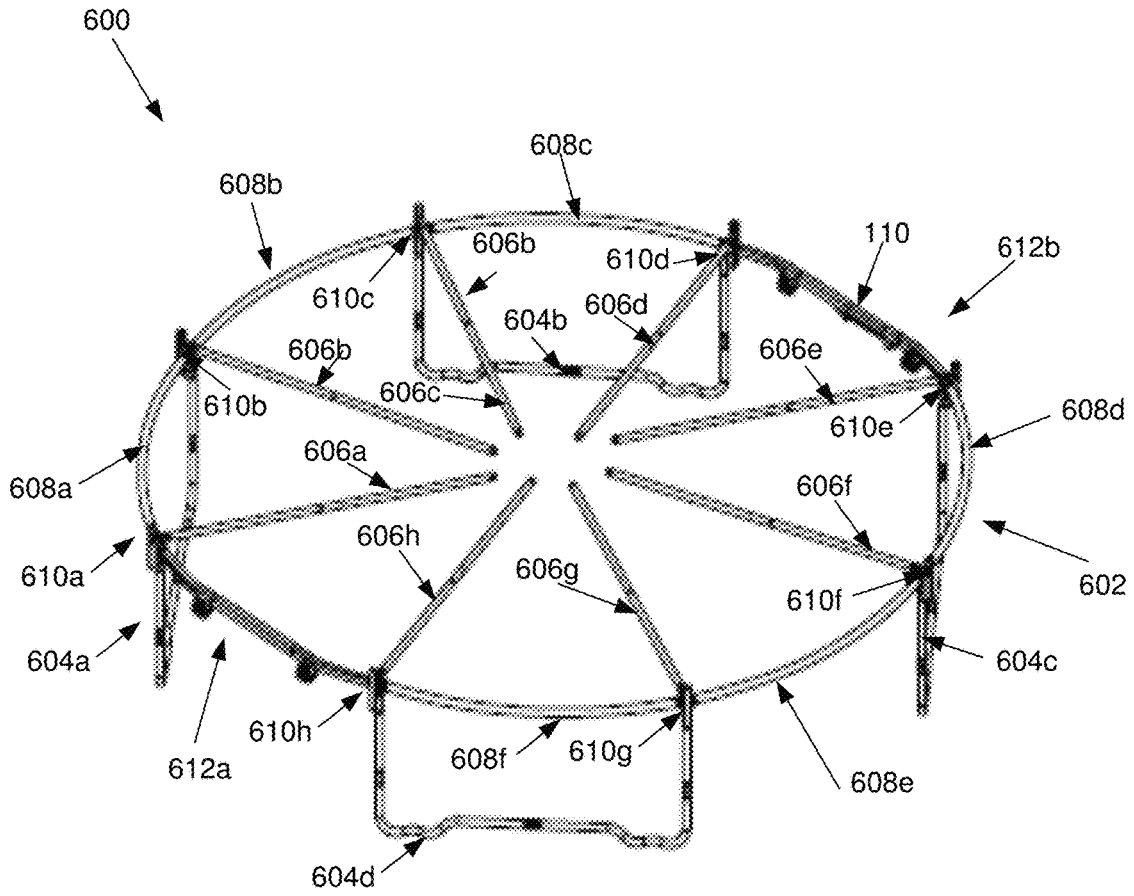
FIG. 10 illustrates an elevational view of an embodiment of the frame assembly of a foldable trampoline in a partially folded state.

FIG. 10 illustrates an elevational view of an embodiment of the frame assembly 602 of a foldable trampoline 600 in a partially folded state. Due to the force of gravity, the net support member 606 remains secure within the bracket 700 until an upward force is applied to disengage the release protrusion 710 from the release notch 704. The net support members 606*a-h* are then folded or pivoted with respect to their respective pivot joints 610*a-h* over the frame assembly 602 inwards towards a center of the frame assembly 602. The net support members 606*a-h* are now in a substantially parallel plane with respect to the frame assembly 602.

In an embodiment, the assembly tension system 110 is configured to release tension to the plurality of springs between the frame assembly 602 and the trampoline mat 320 by reducing a circumference of the frame assembly 602, as described previously herein. Thus, the plurality of springs are in an approximately resting or an unstretched state. In another aspect, the tension of the plurality of springs is released sufficiently for folding of the trampoline 600 but not to a complete unstretched state. Due to the release of the spring tension and decrease in circumference of the frame assembly 602, the tension in the safety net (not shown) is also released. Thus, the safety net may remain attached to the folded net support members 606*a-h*. The springs may comprise any type of resilient devices or materials, such as metal coils, bungie cords, etc.

Figure 11:
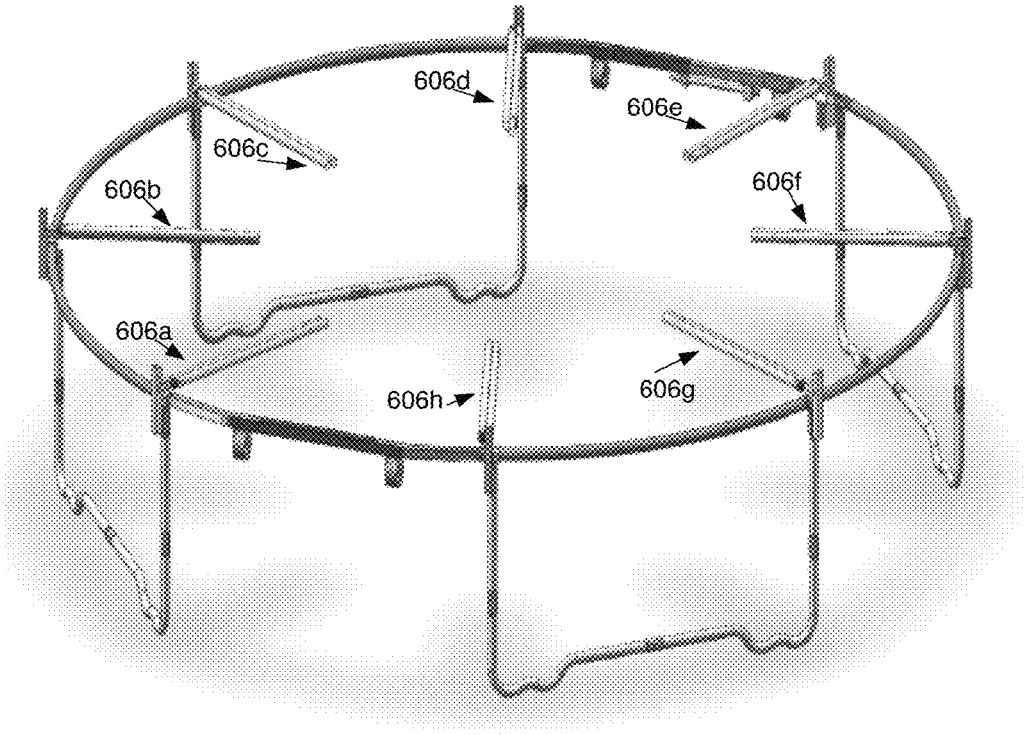
FIG. 11 illustrates an elevational view of an embodiment of the frame assembly of a foldable trampoline in another partially folded state.

FIG. 11 illustrates an elevational view of an embodiment of the frame assembly 602 of the foldable trampoline 600 in another partially folded state. In an embodiment, the net support members 606*a-h* include two or more collapsible component parts. For example, a first component may have a distal end with a geometric shape to fit within and be received by a second component of the net support member 606 and held in an extended state by a fastening mechanism such as a pin, button, etc. In one aspect, the first component may slide into the second component upon release of the fastening mechanism. In another aspect, the first and second components may be foldably attached by a tension cord or hinge or pin or other fastening means that allows the net support members to fold without disengaging. The net support members 606*a-h* may thus be further collapsed. Again, the safety net may remain attached to the folded net support members 606*a-h*.

Figure 12A:
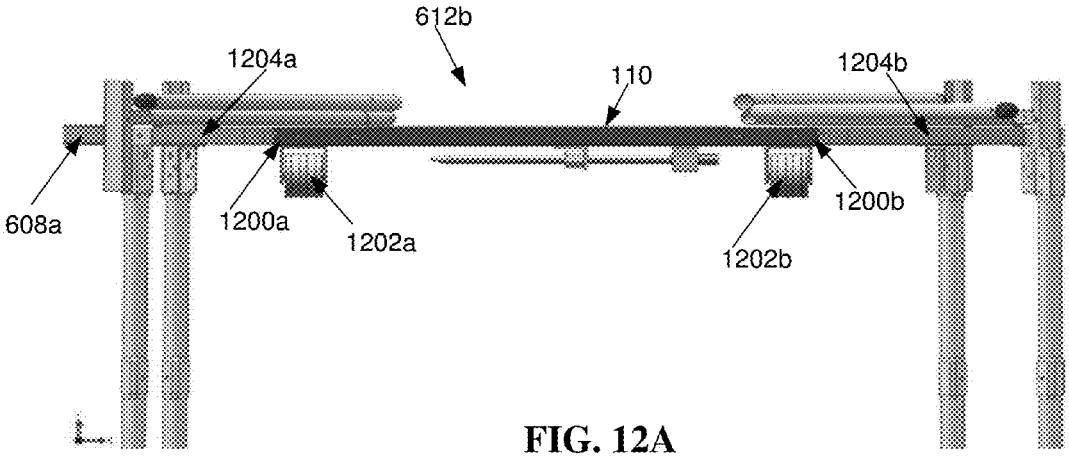
FIG. 12A illustrates an elevational view of an embodiment of the adjustable tension system of the foldable trampoline.

FIG. 12A illustrates an elevational view of an embodiment of the second base member 612*b* including the adjustable tension system 110 of the foldable trampoline 600. In an embodiment, a first end of the adjustable tension system 110 includes a first side pivot joint 1200*a*. The side pivot joint 1200*a* has a similar structure to the pivot joint 610 described with respect to FIG. 7. The first side pivot joint 1204*a* pivotally connects a first foldable member 1204*a* to the adjustable tension system 110 (e.g., via the first connecting member 202 or second connecting member 204 of the adjustable tension system 110). The first foldable member 1204*a* is moveably attached to the adjacent peripheral frame member 608*a*.

A second end of the adjustable tension system 110 includes another side pivot joint 1200*b*. The second side pivot joint 1200*b* pivotally connects the adjustable tension system 110 (e.g., via the first connecting member 202 or second connecting member 204 of the adjustable tension system 110) to an adjacent peripheral frame member 608*f*. A second foldable member 1204*b* may be connected between the adjustable tension system 110 (e.g., via the first or second connecting member 202, 204 of the adjustable tension system 110) and the adjacent peripheral frame member 608*f*. The adjustable tension system 110 further includes one or more wheeled supports 1202*a* and 1202*b* or other type of leg supports.

Figure 12B:
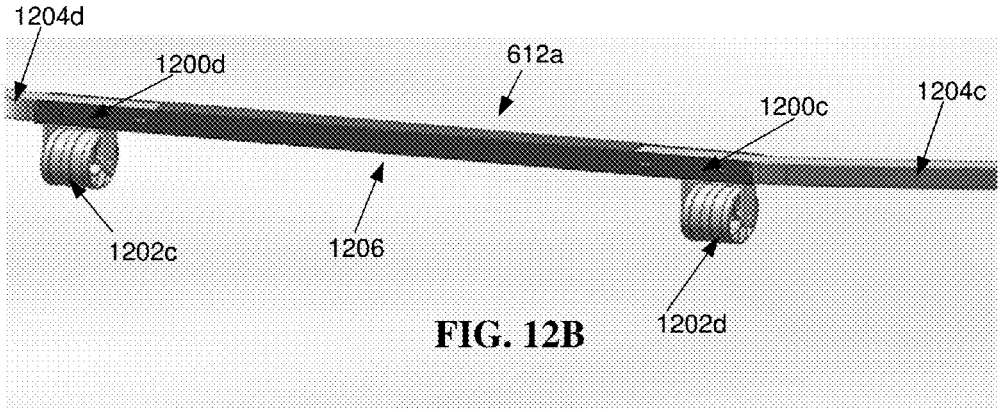
FIG. 12B illustrates an elevational view of an embodiment of the base frame member of the foldable trampoline.

FIG. 12B illustrates an elevational view of an embodiment of the first base frame member 612*a* of the foldable trampoline 600. In an embodiment, the first base member 612*a* includes a base support member 1206 having a first side pivot joint 1200*c* and a second side pivot joint 1200*d*. The first and second side pivot joints 1200*c*, 1200*d* have a similar structure to pivot joint 610. The first side pivot joint 1200*c* pivotally connects a first foldable member 1204*c* to the base support member 1206. The second side pivot joint 1200*d* pivotally connects a second foldable member 1204*d* to the base support member 1206. The base support member 1206 further includes one or more wheeled supports 1202*c* and 1202*d* or other type of leg supports. The first and second foldable members 1204*c*, 1204*d* are moveably attached to peripheral frame members 608.

In FIGS. 12A and 12B, the frame assembly 602 is in a tension state. The adjustable tension system 110 is configured to adjust the tension of the plurality of springs to lock the side pivot joints 1200*a-d*. For example, when the frame assembly is in a tension state, the tension between the peripheral frame members 608 and the foldable members 1204*a-d* compresses the frame assembly 602 and prevents the foldable members 1204*a-d* from sliding with respect to the base support members 612*a,b*. The release protrusion is thus secured within the release notch and the foldable members 1204*a-d* are locked or secured within the side pivot joints 1200*a-d* until tension is released. The foldable members 1204*a-d* thus may not slide out of the side pivot joints 1200*a-d* due to the tension between the peripheral frame members 608 and the foldable members 1204*a-d* in the tension state.

Figure 12C:
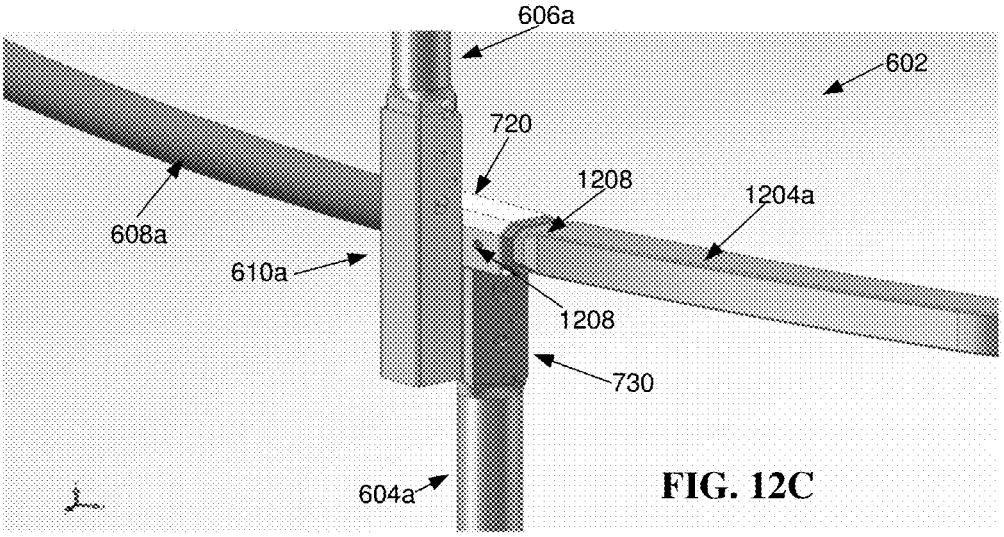
FIG. 12C illustrates an elevational view of an embodiment of the frame assembly in a relaxed state.

FIG. 12C illustrates an elevational view of an embodiment of the frame assembly 102 in a relaxed state. When the adjustable tension system 110 reduces a circumference of the frame assembly 602, the spring tension is reduced, e.g. to a substantially resting or unstretched state. The decreased circumference reduces the tension in the frame assembly 602 as well and in particular, the tension between the peripheral frame members 608 and the foldable members 1204.

For example, as shown in FIG. 12C, the foldable member 1204*a* is movably attached to the peripheral frame member 608*a*. The foldable member 1204*a* has a barrel end 1208 that slides into a hollow end of peripheral frame member 608*a*. However, when the frame assembly 602 is in a tension state, the foldable member 1204*a* is compressed with respect to the peripheral frame member 608*a*. In this tension state, the foldable member 1204*a* may not be easily moved or slid with respect to the peripheral frame member 608*a* for release from the release notch of the pivot joint 1200*a*. When the spring tension is released and the circumference is reduced, the frame assembly 602 is in a relaxed state. The foldable member 1204*a* in this relaxed state may slide with respect to the peripheral frame member 608*a*. This movement of the foldable member 1204*a* disengages the release protrusion 710 from the release notch 704 such that the foldable member 1204*a* may be folded within the pivot joint 1200*a*.

The connecting bracket 720 may include a safety fastening mechanism as well, such as an aperture 1208 for respectively receiving any one of numerous fastening mechanisms, such as pins, clips, buttons, etc. The engagement of the fastening mechanisms prevents unintentional folding or pivoting by the foldable member 1204.

FIG. 13A illustrates an elevational view of an embodiment of the frame assembly 602 of the foldable trampoline 600 in another partially folded state. When the adjustable tension system 110 reduces spring tension, the side pivoting joints 1202 are configured to pivot or fold the peripheral frame members 608 on a first side 1300*a* and the peripheral frame members 608 on a second side 1300*b* of the trampoline 600 into a substantially perpendicular position with respect to the base frame member 612 and the adjustable tension system 110. Due to the release of the spring tension from the decrease in circumference of the frame assembly 602 by the adjustable tension system 110, the tension in the trampoline mat 320 is also released. Thus, the trampoline net 320 may remain attached to the frame assembly 602 in a folded position.

For example, the first side 1300*a* includes peripheral frame members 608*a-c*. The peripheral frame members 608*a-c* are configured to pivot along the side pivot joint 1200*a* that connects the peripheral frame members 608*a-c* to the adjustable tension system 110 and along the side pivot 1200*c* that connects the peripheral frame members 608*a-c* to the base frame member 612. The second side 1300*b* includes peripheral frame peripheral frame members 608*d-f*. The peripheral frame members 608*d-f* are configured to pivot along the side pivot joint 1200*b* that connects the peripheral frame members 608*d-f* to the adjustable tension system 110 and along the side pivot 1200*b* that connects the peripheral frame members 608*d-f* to the base frame member 612.

Figure 13B:
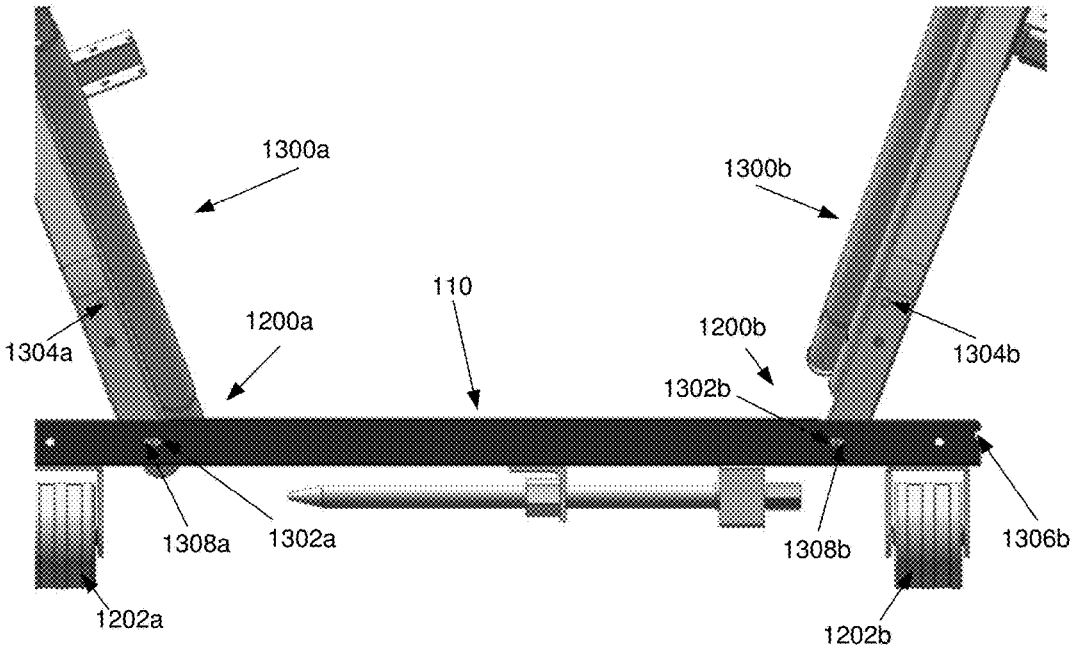
FIG. 13B illustrates an elevational view of an embodiment of the frame assembly of the foldable trampoline including the side joints in more detail.

FIG. 13B illustrates an elevational view of an embodiment of the frame assembly 602 of the foldable trampoline 600 including the side joints 1200*a*, 1200*b* in more detail. For example, the side joint 1200*b* includes a securing aperture 1302*b* and securing protrusion 1308*b*. The securing protrusion 1308*b* pivotally attaches the second side 1300*b* when the release protrusion 1304*b* is removed from the release notch 1306*b*. The adjustable tension system 110 reduces the spring tension such that the peripheral side members 108 may slide along the securing aperture 1302*b* with respect to the pivot joint 1200*b* and disengage the release notch 1306*b* from the release protrusion 1304*b*. The peripheral frame members 608*d-f* of the second side 1300*b* may then be pivoted from an extended substantially horizontal position to a folded position that is substantially vertical, e.g. in a perpendicular position with respect to the base frame member 612 and the adjustable tension system 110.

Similarly, the side joint 1200*a* includes a securing aperture 1302*a* and securing protrusion 1308*a*. The securing protrusion 1308*a* pivotally attaches the first side 1300*a* when the release protrusion 1304*a* is removed from its corresponding release notch (not shown). The adjustable tension system 110 reduces the spring tension such that the peripheral side members 108 may slide along the securing aperture 1302*a* with respect to the pivot joint 1200*a* and disengage the release notch (not shown) from the release protrusion 1304*a*. The spring tension is reduced in an amount to at least disengage the release protrusion 1304*a* from the release notch. The first side 1300*a* may then be pivoted from an extended substantially horizontal position to a folded position that is substantially vertical, e.g. in a perpendicular position with respect to the base frame member 612 and the adjustable tension system 110.

Figure 14:
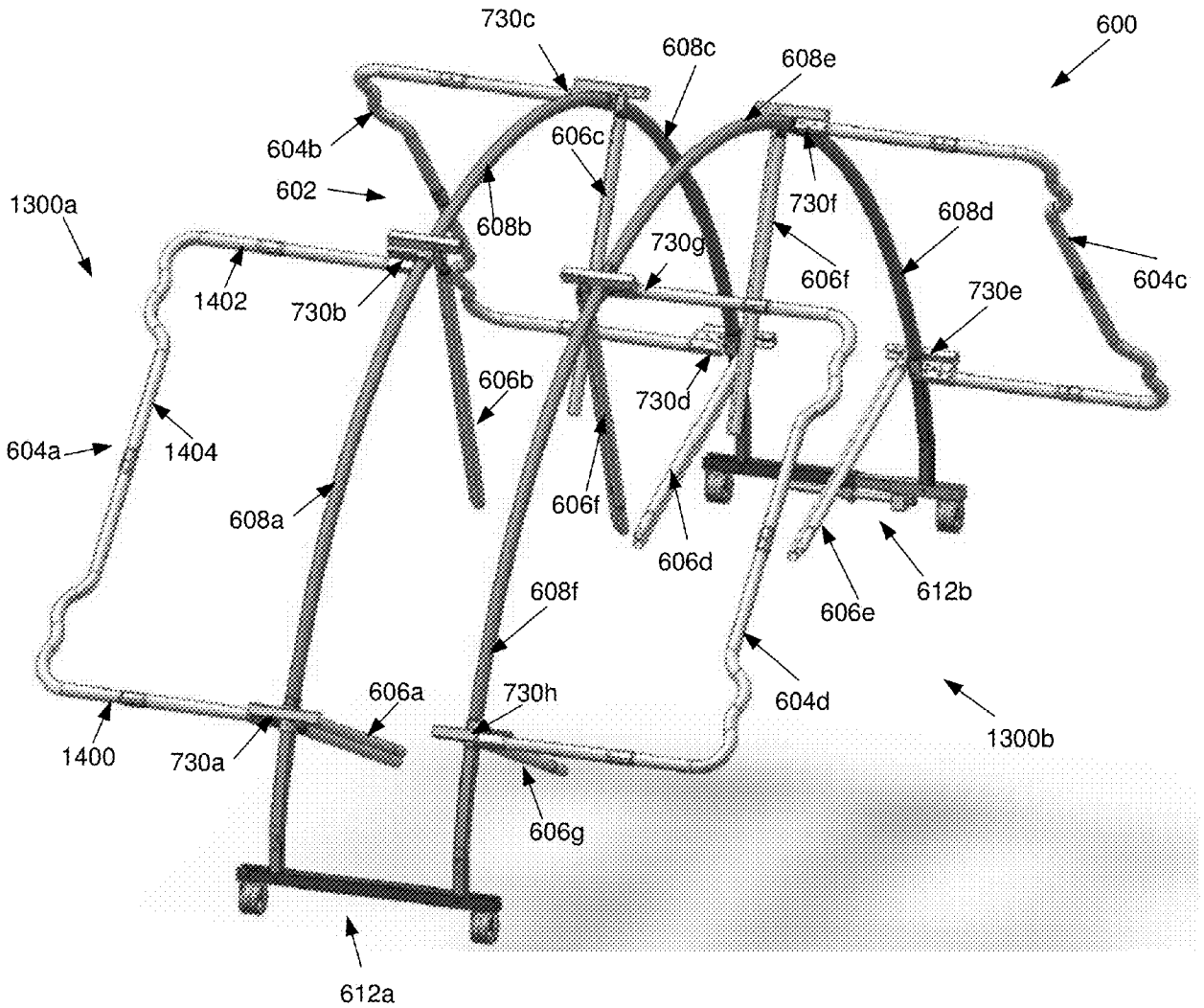
FIG. 14 illustrates an elevational view of an embodiment of the foldable trampoline in another partially folded state.

FIG. 14 illustrates an elevational view of an embodiment of the foldable trampoline 600 in another partially folded state. The peripheral frame members 608*a-c* on a first side 1300*a* and the peripheral frame members 608*d-f* on a second side 1300*b* of the trampoline 600 have been folded into a substantially perpendicular position with respect to the base frame member 612 and the adjustable tension system 110. The trampoline net 320 may remain attached to the frame assembly 602 in this folded position. The net support members 606*a-g* are also folded and extend inwards in a perpendicular position with respect to the peripheral frame members 608. The safety net may also remain attached to the net support members 606*a-g* in this folded position. The foldable trampoline 600 may be rolled for storage or replacement.

However, the leg support members 604*a-d* remain in an extended state, and so the foldable trampoline 600 may still be cumbersome to move or store. It would be advantageous to further reduce the size of the foldable trampoline 600 by folding the leg support members 604*a-d*.

In an embodiment, the leg support members 604*a-d* may be pivotally connected to the frame assembly 602 of the trampoline 600. To facilitate further folding of the trampoline 600, the leg support members 604*a-d* may be folded from an extended state to a collapsed state and vice-versa. In one aspect, the leg support members 604*a-d* are pivotally connected to the peripheral frame members 608*a-f* by leg pivot joints 730*a-h* that have a similar corresponding structure to pivot joints 610.

In an embodiment, the leg support members 604*a-d* have a substantially u-shaped structure as shown in FIG. 14. For example, the leg support member 604*a* includes a first leg 1400, a second leg 1402 and a ground support 1404 connecting the first leg 1400 and the second leg 1402. To enable the u-shaped leg support members to fold inward, the leg pivot joints 730*a-h* are attached to the leg support members 604*a-d* at an angle as shown in FIG. 7. The leg pivot joints 730*a*, 730*b* connected to the opposing first and second legs 1400, 1402 are angled towards the other to inwardly fold the u-shaped leg support members 604*a-d*. For example, the first leg pivot joint 730*a* is attached to the first leg 1400 at first inward angle, and the second leg pivot joint 730*b* is attached to the second leg 1402 at a second inward angle. A release protrusion may be disengaged from a release notch on the leg pivot joints 730*a-h* as described with respect to pivot joints 610. The leg support members 604*a-d* may then be folded into an inwards position. In an embodiment, the leg pivot joints 730*a-h* may alternatively or further include one or more other apertures (such as apertures 706, 708) for respectively receiving any one of numerous other fastening mechanisms, such as pins, clips, buttons, etc. These one or more other fastening mechanisms may be employed to provide alternative or additional safety measures to prevent unintentional folding of the leg support members 604*a-d*.

Figure 15:
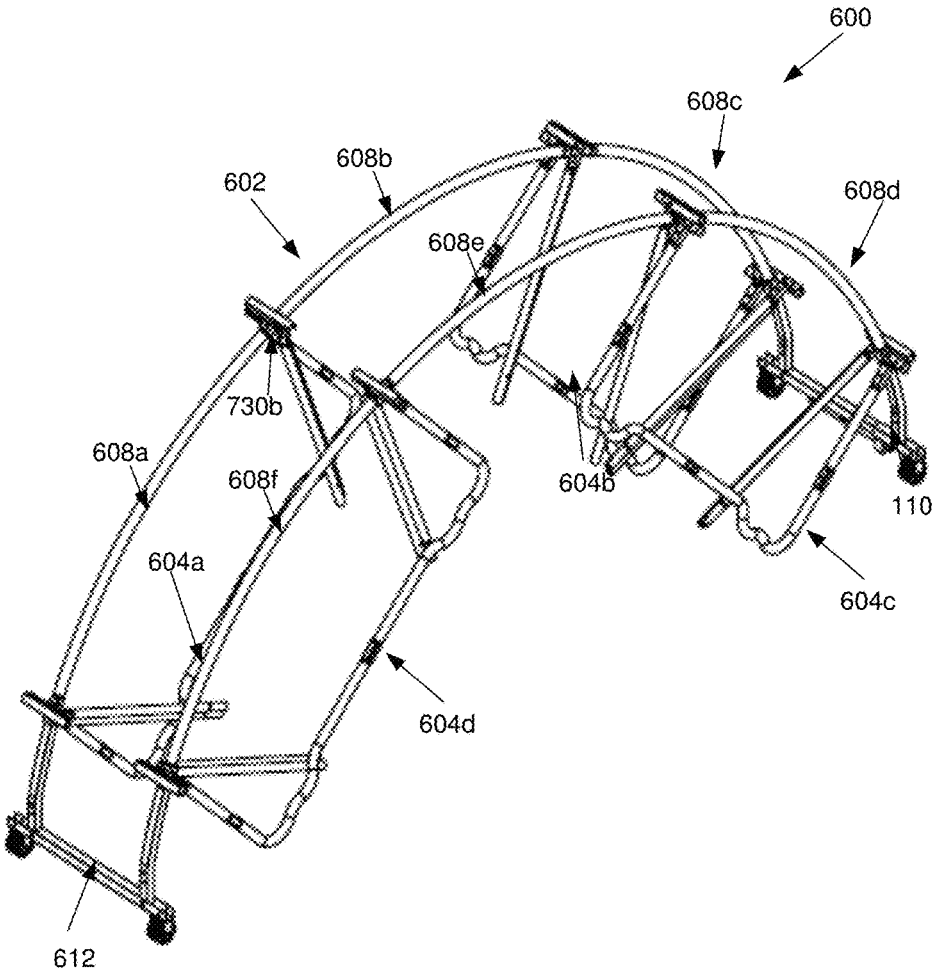
FIG. 15 illustrates an elevational view of an embodiment of the foldable trampoline in a fully folded state.

FIG. 15 illustrates an elevational view of an embodiment of the foldable trampoline 600 in a fully folded state. The leg support members 604*a-d* are folded along leg pivot joints 730*a-h* into an inwards position. The peripheral frame members 608*a-c* on a first side 1300*a* and the peripheral frame members 608*d-f* on a second side 1300*b* of the trampoline 600 have been folded into a substantially perpendicular position with respect to the base frame member 612 and the adjustable tension system 110. Due to the release of the spring tension and decrease in circumference of the frame assembly 602 by the adjustable tension system 110, the tension in the trampoline mat 320 is also released. Thus, the trampoline net 320 may remain attached to the frame assembly 602.

Figure 16:
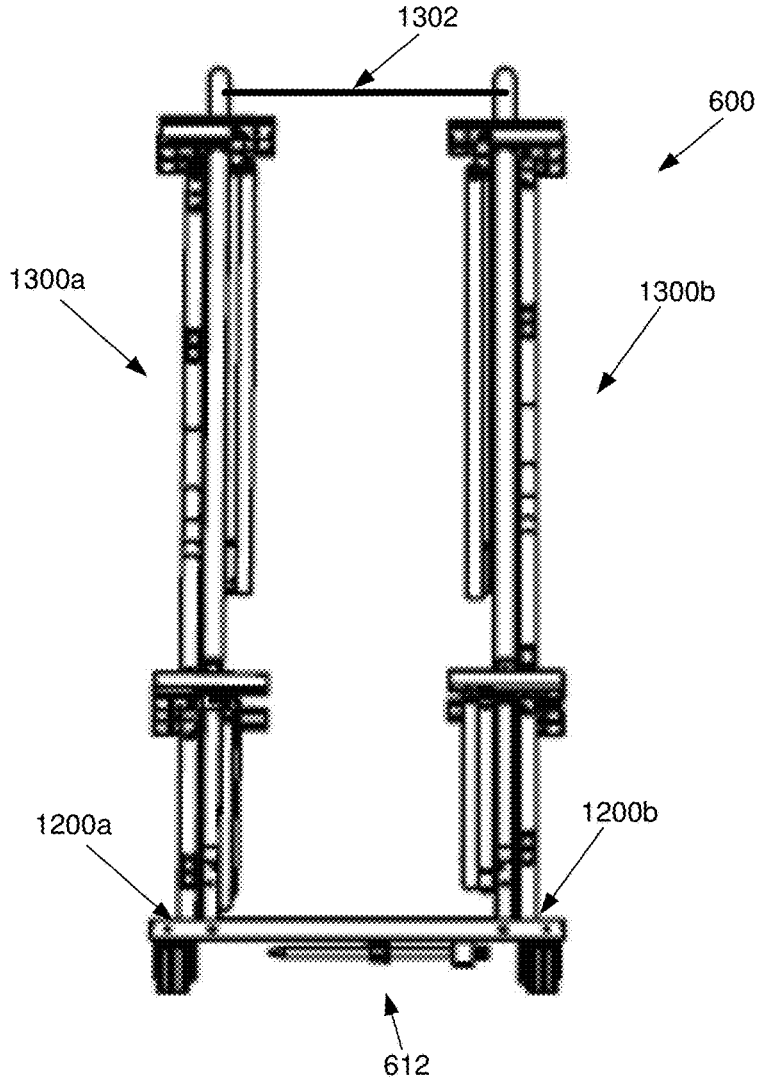
FIG. 16 illustrates a side end view of an embodiment of the foldable trampoline in a fully folded state.

FIG. 16 illustrates a side end view of an embodiment of the foldable trampoline 600 in a fully folded state. The peripheral frame members 608*a-c* on a first side 1300*a* and the peripheral frame members 608*d-f* on a second side 1300*b* of the trampoline 600 have been folded into a substantially perpendicular position with respect to the base frame member 612 and the adjustable tension system 110. The leg support members 604*a-d* are folded along leg pivot joints 730*a-h* into an inwards position that is parallel to the peripheral frame members 608*a-c* and a substantially perpendicular position with respect to the base frame member 612 and the adjustable tension system 110.

A safety mechanism may be implemented to prevent the first side 1300*a* and the second side 1300*b* from unintentionally unfolding. For example, a strap 1302 may be attached to the first side 1300*a* and the second side 1300*b*. In another aspect, a cranking system may be implemented to fold and unfold the first side 1300*a* and the second side 1300*b*.

In an embodiment, a foldable trampoline includes a frame assembly including at least two base members connected on a left side by one or more peripheral frame members and on a right side by one or more peripheral frame members. At least one of the base members or the peripheral frame members includes an adjustable tension system. The adjustable tension system decreases a circumference of the foldable trampoline frame assembly to release tension in a plurality of springs between a trampoline mat and the frame assembly. The left side and the right side of the frame assembly fold from a parallel position to a substantially perpendicular position with respect to the two base members. Thus, the two base members support the first side of the trampoline and the second side of the trampoline in a folded position using one or more wheeled supports or other type of leg supports. In the folded position, supporting members of the trampoline may be folded inwards as well.

Convertible Trampoline Tent

A trampoline is typically openly exposed to natural elements such as rain, sun, wind, and the like. To protect the trampoline from such elements when not in use, covers have been placed over trampolines. Conventional covers typically comprise canvas or plastic sheets which are simply tied or secured to lay flat on the trampoline mat. Although useful in protecting the trampoline mat and springs, simply placing a cover over the trampoline does not achieve other objectives which are often desirable to a homeowner. For example, it would be desirable if a trampoline cover could also function as a trampoline tent. The trampoline tent may protect those sleeping on the trampoline from the weather and from bugs and insects. The trampoline tent may also prevent users from rolling off the trampoline during sleep. A problem with placing a conventional tent on a trampoline is that the tents are typically difficult and time consuming to both assemble and disassemble. Furthermore, the tent is generally required to be fully disassembled to enable conventional use of the trampoline. Thus, there is a need for a trampoline that may be easily converted to a tent.

Figure 17:
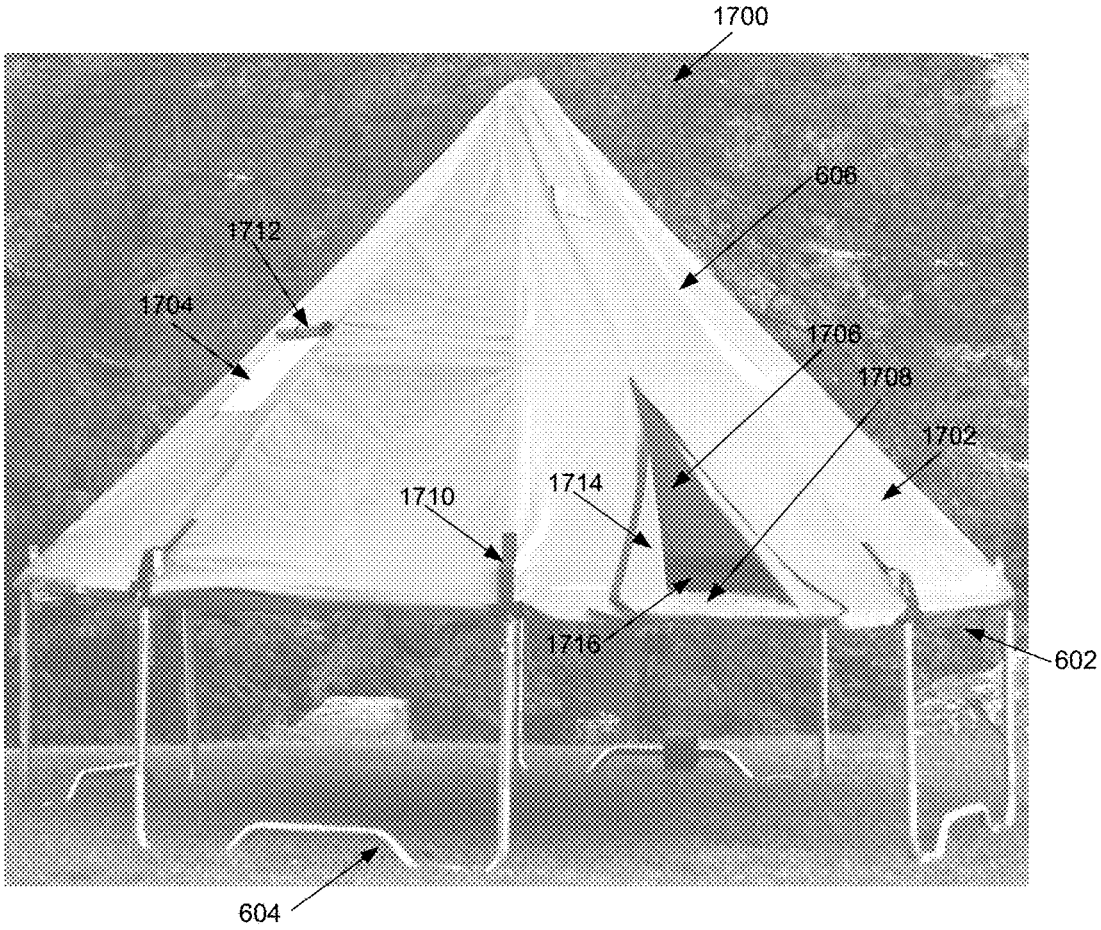
FIG. 17 illustrates an elevational view of an embodiment of a convertible trampoline tent.

FIG. 17 illustrates an elevational view of an embodiment of a convertible trampoline tent 1700. A cover 1702 is supported by a plurality of net support members 606 which may also support a safety net (not shown). The cover 1702 may include one or more window openings 1706 and one or more doorways 1704. The window has a window cover 1712 which may be rolled up as illustrated in FIG. 17. In a similar fashion, one or more doorway flaps 1714 or other types of door coverings may be included in the cover 1702 as well.

The cover 1702 is preferably made of a soft foldable material such as canvas or nylon which enables the cover 1702 to be selectively folded around the plurality of net support members 606. The cover 1702 may include a plurality of removably attached sheets or a single sheet of material. In an embodiment, the cover 1702 is detachably attached to the net support members 606 by ties or straps 1710 each extending from the periphery of the cover 1702 for tying or otherwise securing about an upper end portion of the leg support members 604. An apron 1708 is attached to the frame assembly 602 and/or a trampoline mat 1716 and is configured to cover the plurality of springs between the frame assembly 602 and the trampoline mat 1716. The plurality of net support members 606 may include padding to prevent injury due to jumping or bouncing on the trampoline mat 1716.

Figure 18:
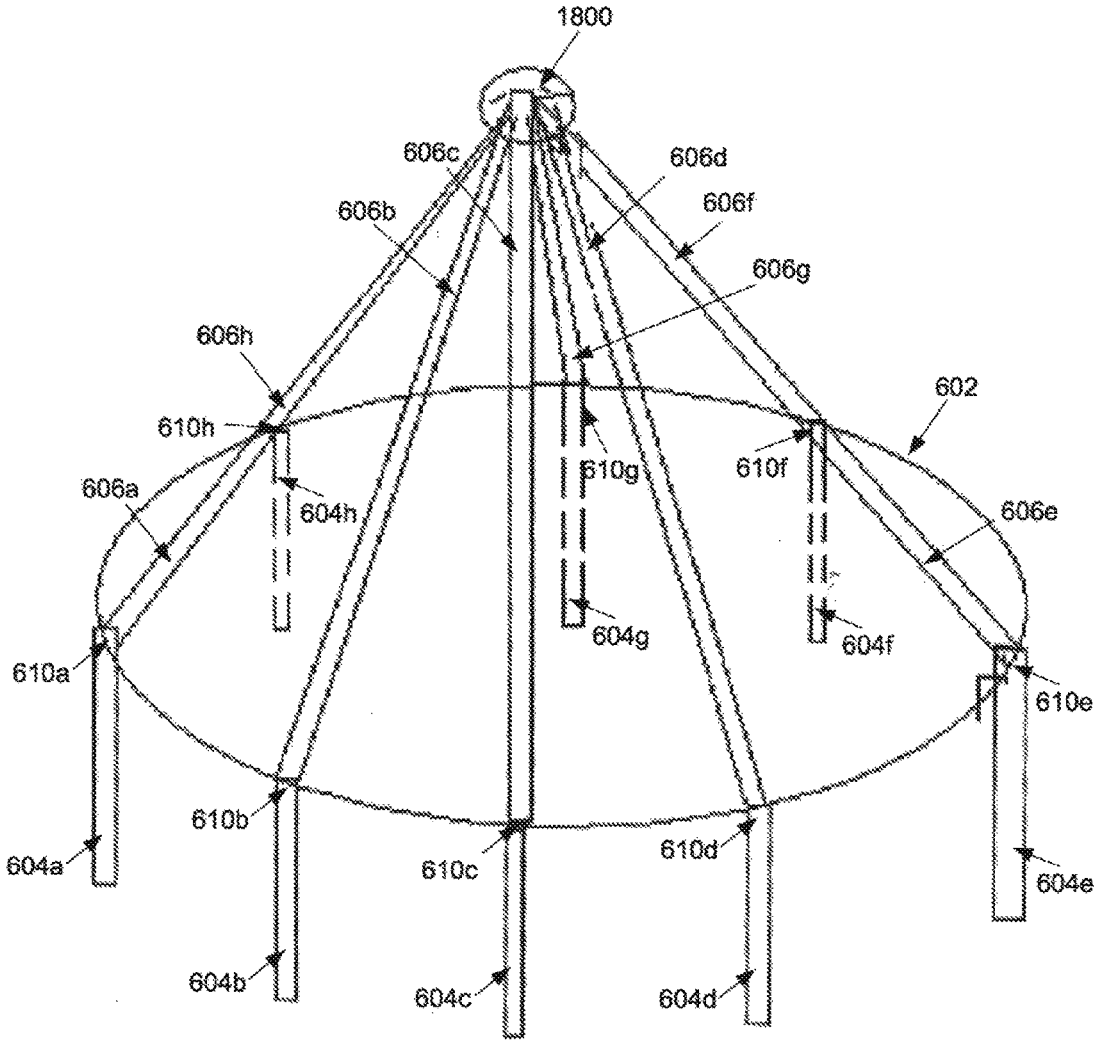
FIG. 18 illustrates an elevational view of an embodiment of the convertible trampoline tent in the tent position.

FIG. 18 illustrates an elevational view of an embodiment of the convertible trampoline tent 1700 in the tent position. In an aspect, the net support members 606*a-h* are pivotally attached to the frame assembly 602 and/or the plurality of leg support members 604*a-h* by respective pivot joints 610*a-h*. The pivot joints 610*a-h* are configured to allow a respective net support member 606*a-h* to pivot over the frame assembly 602 inwards towards the center of the circumference of the frame assembly 602. A cover support 1800 is removably attached to a top portion of the net support members 606*a-h* and is configured to support the net support members 606*a-h* at an acute angle with respect to the trampoline mat 1716 at an approximately central point over the trampoline mat 1716. The cover 1702 may then be wrapped and secured around the partially folded net support members 606*a-h* and secured to the cover support 1800 and/or the leg support members 604.

Figure 19:
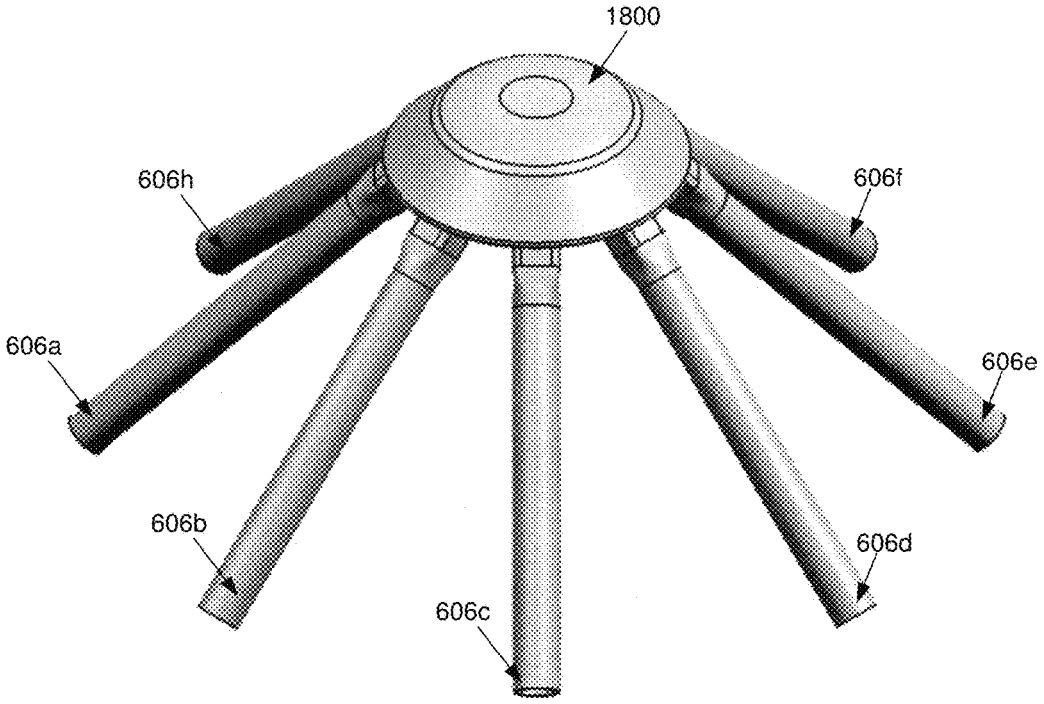
FIG. 19 illustrates an elevational view of an embodiment of the cover support of the convertible trampoline tent in the tent position.

FIG. 19 illustrates an elevational view of an embodiment of the cover support 1800 of the convertible trampoline tent 1700 in the tent position. The cover support 1800 is removably attached to a top portion of the net support members 606*a-h* and is configured to support the net support members 606*a-h* in a partially folded position. The cover support 1800 may comprise a rigid material, such as a metal or metallic alloy, or may comprise a flexible material, such as a plastic.

Figure 20:
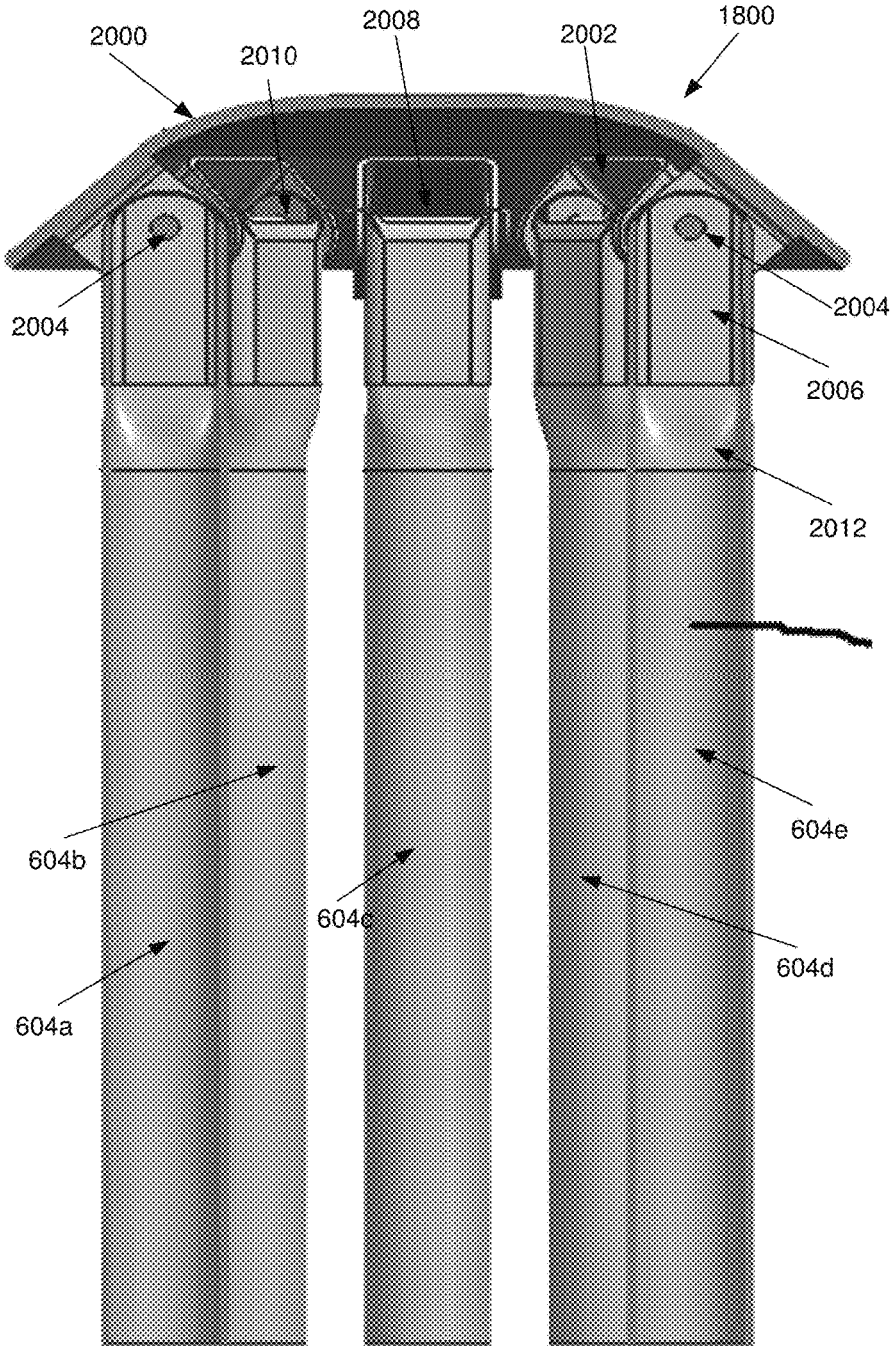
FIG. 20 illustrates a cross-sectional view of an embodiment of the cover support of the convertible trampoline tent.

FIG. 20 illustrates a cross-sectional view of an embodiment of the cover support 1800 of the convertible trampoline tent 1700. The cover support 1800 includes a rigid top member 2000 having a curved or convex shape. A top portion 2006 of each of the net support members 606*a-h* are rigidly or rotatably coupled to a top bracket 2002. For example, in an embodiment, opposing sides of the top portion 2006 of each of the net support members 606 forms apertures 2004. The apertures 2004 align with corresponding bracket apertures 2010. A securing mechanism 2008, such as a pin or bolt or screw, is threaded through the apertures 2004 of the net support members 606 and the bracket apertures 2010 to rotatably secure the net support members 606 to the cover support 1800. Each of the net support members 606 are thus able to rotate into a predetermined angle for attachment to the cover support 1800 for various sized trampolines. In another embodiment, the net support members 606 are fixedly attached to their respective top brackets 2002.

The top portion 2006 of the net support member 606 may be rotatable with respect to the net support member 606. The top portion 2002 may rotate to assist in aligning the apertures 2004 on the top portion 2006 with the bracket apertures 2010.

Figure 21:
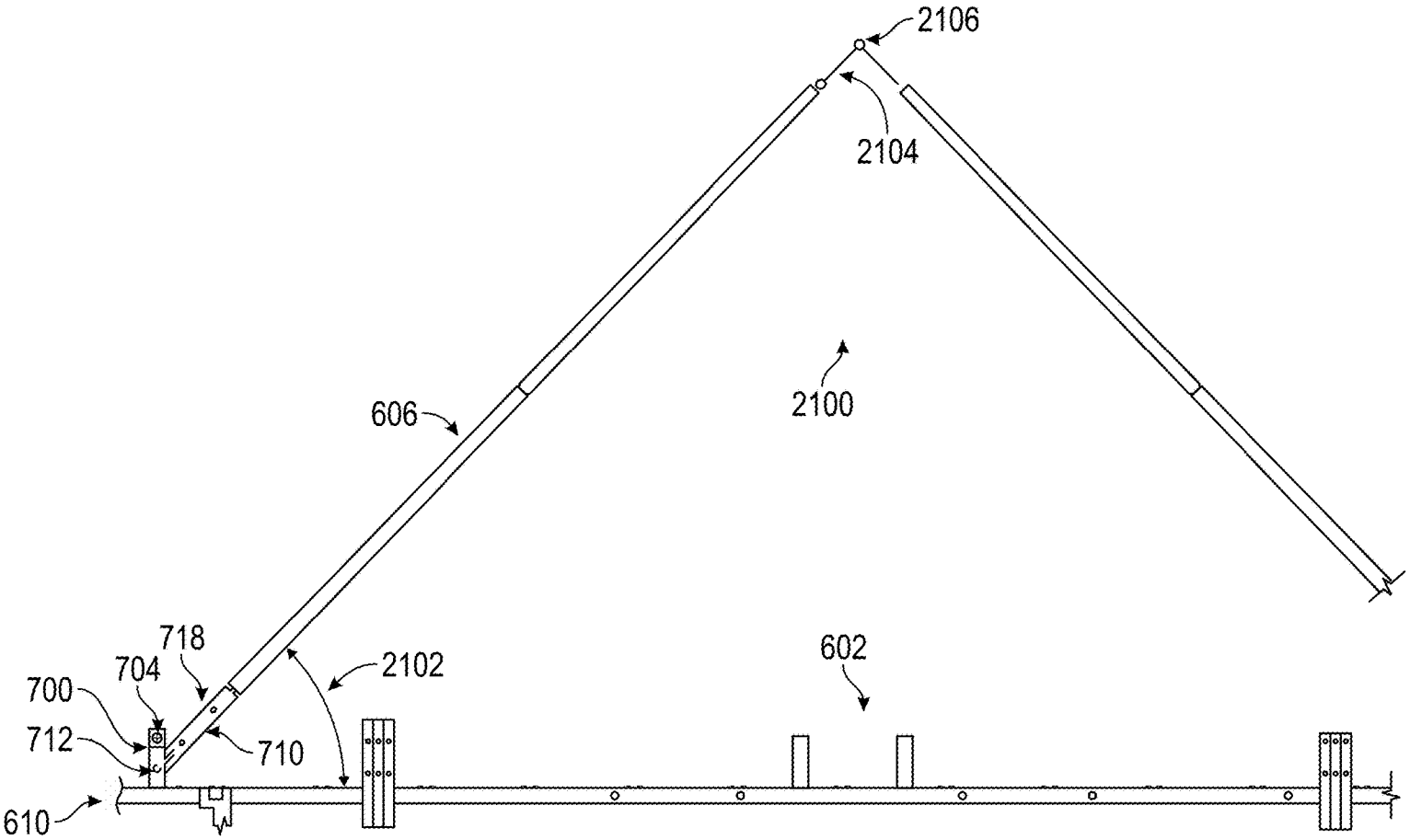
FIG. 21 illustrates a side view of an embodiment of a net support member in a tent position.

FIG. 21 illustrates a side view of an embodiment of a net support member 606 in a tent position. In an embodiment, the net support member 606 is pivotally attached to the frame assembly 602 and/or a leg support member 604*a-h* by a respective pivot joint 610. In an embodiment, the base structure 718 of the net support member 606 is configured to slide or move towards a top opening of the bracket 700 guided by the securing protrusion 712 within the securing aperture 702. The base structure 718 is operable to slide or move until the securing protrusion 712 engages an upper end 716 of the securing aperture 702 that halts further movement. The engagement of the securing protrusion 712 with the securing aperture 702 on the first side (and similarly with corresponding structures on the second opposing side of the bracket 700) prevents detachment of the net support member 606 from the bracket 700. However, the movement of the base structure 718 along the bracket 700 is sufficient to disengage a release protrusion 710 from a release notch 704.

In an embodiment, the securing protrusion 712 has a length equal to or greater than a clearance length, wherein the clearance length is the distance that the base structure 710 must move to disengage the release protrusion 710 from the release notch 704. The clearance length is determined based on this distance that the net support member 606*a* must slide to disengage the release protrusion 710 from the release notch 704. The securing protrusion 712 of the base structure 718 acts as a pivot within the securing aperture 702 while securing the base structure 718 within the bracket 700. The securing protrusion 712 is thus configured as a pivot on which the net support member 606 may swivel or pivot or fold through a top bracket opening 900 over the frame assembly 602.

In a tent position, the net support member 606 is pivoted to a predetermined angle 2102 with respect to the frame assembly 602. The predetermined angle 2102 may be any acute angle with respect to the frame assembly such that the net support member may be attached to the cover support 1800. The predetermined angle 2102 may vary depending on the length of the net support members 606 and the circumference of the trampoline 1700.

For example, the predetermined angle 2102 positions the net support member 606 within a predetermined distance 2104 from a center point 2106 of the cover support 1800 for attachment to one of the plurality of brackets 2002. Again, the predetermined distance 2104 and the predetermined angle 2102 may vary depending on the length of the net support members 606, the position of the brackets 2002 on the cover support 1800, the width of the cover support 1800, the circumference of the trampoline 1700, etc.

The pivot joint 610 thus enables folding or pivoting of the net support member 606 to attach to the cover support 1800. The net support members 606 thus remain secured to their respective brackets 700 in this partially folded tent position and do not need to be completely detached, disassembled or separated from the frame assembly 602. Though the pivot joints 610 may have a similar structure to the pivot joints described with respect to FIGS. 7-9, the pivot joints 610 may be implemented with other components or devices, such as hinges, pins, etc.

Figure 22:
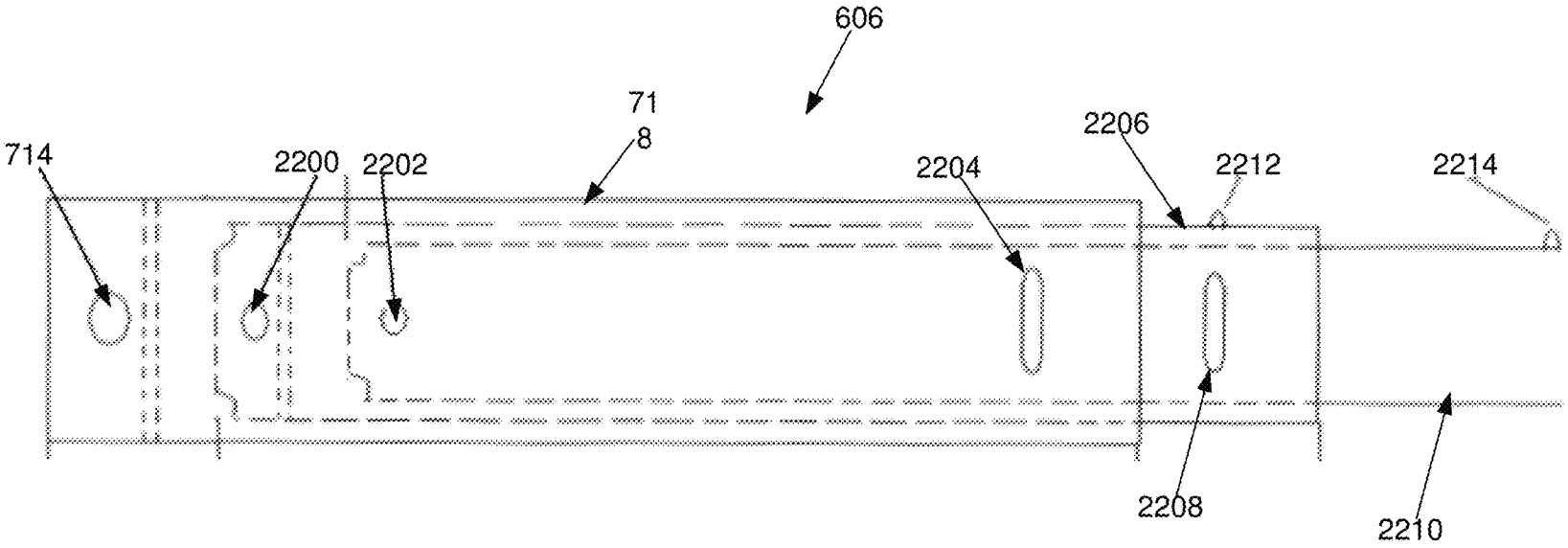
FIG. 22 illustrates a side view of an embodiment of a net support member for the convertible tent trampoline.

FIG. 22 illustrates a side view of an embodiment of a net support member 606 for a convertible tent trampoline 1700. The net support member 606 must have a sufficient length such that when folded, the net support member 606 is positioned for attachment to the cover support 1800, e.g. positioned within the predetermined distance 2104 from the center point 2106 of the cover support 1800. The net support member 606 may need to include one or more extensions to reach this position. In an embodiment, the net support member 606 includes a first extension 2206 and a second extension 2210 that are slidably attached to base structure 718 of the net support member 606.

In a vertical position, a first protrusion 2212, such as weld point or button, engages the base structure 718 of the net support member 606 to prevent the first extension 2206 from further movement into the base structure 718. Similarly, in a vertical position, second protrusion 2214 engages first extension 2206 to prevent further movement into the base structure 718 or first extension 2206. Thus, the first extension 2206 and the second extension 2210 may be in a contracted state when the net support member 606 is in a vertical position. In this contracted state, a first extension aperture 2200 is configured to be aligned with a second extension aperture 2210. A fastening mechanism, such as a pin, button or other component, may be used to secure the first extension 2206 to the second extension 2210 in this contracted state. In addition, an elongated aperture 2204 in the base structure 718 is configured to be aligned with an elongated aperture 2208 in the first extension 2206 in this contracted state. A fastening mechanism, such as a pin, button or other component, may be used to secure the elongated aperture 2204 in the base structure 718 to the elongated aperture 2208 in the first extension 2206 in this contracted position.

In an embodiment, the first extension 2206 and the second extension 2210 may be extended to increase the length of the net support member 606. The one or more fastening mechanisms are removed from the apertures. The net support member 606 may then be elongated to have a sufficient length such that when folded, the net support member 606 has a sufficient length for attachment to the cover support 1800.

Figure 23:
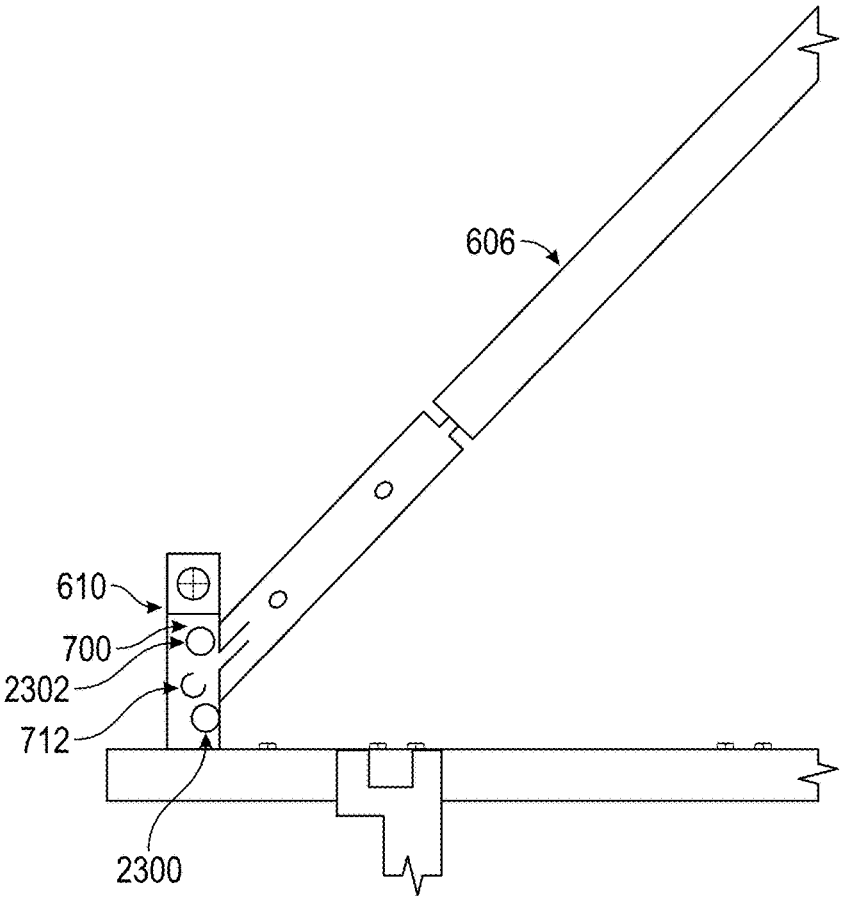
FIG. 23 illustrates a side view of an embodiment of a net support member and a pivot joint in a tent position.

FIG. 23 illustrates a side view of an embodiment of a net support member 606 and pivot joint 610 in a tent position. In an embodiment, the pivot joint 610 includes one or more tent lock mechanisms 2300 and 2302 that secures the net support member 606 in a tent position. For example, a first tent lock mechanism 2300 includes a bar, including e.g. a pin, clip, etc., that is removable from an aperture formed in the bracket 700. The bar engages the net support member 606 at the predetermined angle and prevents the net support member 606 from folding. When the bar is moved sufficiently from the aperture to disengage the net support member 606, the net support member 606 may be further folded, e.g. for storage or movement. In another aspect, a second tent lock mechanism 2302 may include a bar that is removable from aligned apertures on the bracket 700 and the net support member 606. The apertures in the bracket 700 and the net support member align when the net support member 606 is at the predetermined angle for the tent position. A bar is then slid into the aligned apertures to secure the net support member 606.

When the one or more tent lock mechanism 2300, 2302 are implemented, the trampoline 1700 may not need to employ the cover support 1800 for attachment of the net support members 606. The one or more tent lock mechanisms 2300, 2302 secure the net support members 606 at an acute angle in a tent position. The cover 1702 may then be supported by the plurality of net support members 606.

A convertible tent trampoline 1700 includes a plurality of net support members 606 that are pivotally attached to a frame assembly 602. The net support members 606 are pivoted to a predetermined angle and/or a predetermined length. A cover 1702 is supported by the plurality of net support members 606 which may also support a safety net (not shown). The cover 1702 includes one or more window openings 1706 and one or more doorways 1704. The convertible tent trampoline 1700 is thus easily assembled and functions as a tent and/or as a protective covering for the trampoline 1700.

As may be used herein, the term "operable to" or "configurable to" indicates that an element includes one or more of circuits, instructions, modules, data, input(s), output(s), etc., to perform one or more of the described or necessary corresponding functions and may further include inferred coupling to one or more other items to perform the described or necessary corresponding functions. As may also be used herein, the term(s) "coupled", "coupled to", "connected to" and/or "connecting" or "interconnecting" includes direct connection or link between nodes/devices and/or indirect connection between nodes/devices via an intervening item (e.g., an item includes, but is not limited to, a component, an element, a circuit, a module, a node, device, network element, etc.). As may further be used herein, inferred connections (i.e., where one element is connected to another element by inference) includes direct and indirect connection between two items in the same manner as "connected to".

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, frequencies, wavelengths, component values, integrated circuit process variations, temperature variations, rise and fall times, and/or thermal noise. Such relativity between items ranges from a difference of a few percent to magnitude differences.

Note that the aspects of the present disclosure may be described herein as a process that is depicted as a schematic, a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function.

The various features of the disclosure described herein can be implemented in different systems and devices without departing from the disclosure. It should be noted that the foregoing aspects of the disclosure are merely examples and are not to be construed as limiting the disclosure. The description of the aspects of the present disclosure is intended to be illustrative, and not to limit the scope of the claims. As such, the present teachings can be readily applied to other types of apparatuses and many alternatives, modifications, and variations will be apparent to those skilled in the art.

In the foregoing specification, certain representative aspects of the invention have been described with reference to specific examples. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described. For example, the components and/or elements recited in any apparatus claims may be assembled or otherwise operationally configured in a variety of permutations and are accordingly not limited to the specific configuration recited in the claims.

Furthermore, certain benefits, other advantages and solutions to problems have been described above with regard to particular embodiments; however, any benefit, advantage, solution to a problem, or any element that may cause any particular benefit, advantage, or solution to occur or to become more pronounced are not to be construed as critical, required, or essential features or components of any or all the claims.

As used herein, the terms "comprise," "comprises," "comprising," "having," "including," "includes" or any variation thereof, are intended to reference a nonexclusive inclusion, such that a process, method, article, composition or apparatus that comprises a list of elements does not include only those elements recited, but may also include other elements not expressly listed or inherent to such process, method, article, composition, or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

Moreover, reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is intended to be construed under the provisions of 35 U.S.C. § 112(f) as a "means-plus-function" type element, unless the element is expressly recited using the phrase "means for" or, in the case of a method claim, the element is recited using the phrase "step for."

What is claimed is:

1. A trampoline, comprising:

a trampoline mat;

a plurality of springs attached to the trampoline mat; and a folding frame assembly configured to support the trampoline mat using the plurality of springs, wherein the folding frame assembly includes an adjustable tension system configured to adjust a circumference of the folding frame assembly to increase or decrease a tension of the plurality of springs, and wherein the folding frame assembly includes a plurality of peripheral folding frame members coupled to the adjustable tension system and defining the circumference, the plurality of peripheral folding frame members configured to fold with respect to the adjustable tension system, and a plurality of folding legs, where the plurality of folding legs fold while attached to the peripheral folding frame members and wherein in a folded configuration the adjustable tension system serves as support for the folding frame assembly.

2. The trampoline of claim 1, wherein the adjustable tension system comprises:

a first connecting member; and a second connecting member moveably attached to the first connecting member to adjust a circumference of the folding frame assembly.

3. The trampoline of claim 2, wherein the first connecting member is configured to slidably move in a first direction with respect to the second connecting member to increase the circumference of the folding frame assembly and increase a tension in the plurality of springs.

4. The trampoline of claim 3, wherein the first connecting member is configured to slidably move in a second direction with respect to the second connecting member to decrease the circumference of the folding frame assembly and decrease a tension in the plurality of springs.

5. The trampoline of claim 2, wherein the first connecting member includes a first external portion and a second adjustable portion, wherein the second adjustable portion is configured to move with respect to the second connecting member to decrease the circumference of the folding frame assembly and decrease a tension in the plurality of springs.

6. The trampoline of claim 2, wherein the first connecting member includes a first external portion and a second adjustable portion, wherein the second adjustable portion is configured to move with respect the second connecting member to increase the circumference of the folding frame assembly and increase a tension in the plurality of springs.

7. The trampoline of claim 2, wherein the adjustable tension system further includes:

a bolt and nut assembly to slidably attach the first connecting member and the second connecting member, wherein the bolt and nut assembly includes:

a bolt fixedly attached to the second connecting member; and a bolt head structure fixedly attached to the first connecting member, wherein the bolt head structure rotatably secures the bolt to the first connecting member using an adjusting nut.

8. The trampoline of claim 7, wherein an adjustable portion of the first connecting member slides into the second connecting member and decreases the circumference of the folding frame assembly when a first rotational force is applied to an adjusting nut in a first direction; and wherein the adjustable portion slides further from the second connecting member and increases the circumference of the folding frame assembly when a second rotational force is applied to the adjusting nut in a second direction.

9. The trampoline of claim 2, wherein the adjustable tension system further includes at least one of a hydraulic jack or an air cylinder to moveably attach the first connecting member with respect to the second connecting member.

10. The trampoline of claim 2, wherein the adjustable tension system further includes a gear assembly to moveably attach the first connecting member with respect to the second connecting member.

11. The trampoline of claim 1, wherein in the folded configuration the plurality of peripheral folding frame members fold into each other while the plurality of folding legs fold without disassembly.

12. The trampoline of claim 1, wherein in an unfolded configuration the plurality of folding legs provide support for the folding frame assembly.

13. The trampoline of claim 1, wherein in an unfolded configuration the adjustable tension system is lifted from a ground position by the plurality of folding legs.

14. A trampoline, comprising:

a trampoline mat;

a plurality of springs attached to the trampoline mat; and a folding frame assembly configured to support the trampoline mat using the plurality of springs, wherein the folding frame assembly includes an adjustable tension system coupled thereto, the adjustable tension system configured to adjust a circumference of the folding frame assembly to increase or decrease a tension of the plurality of springs, wherein the folding frame assembly is configured to fold with respect to the adjustable tension system, and wherein the adjustable tension system remains attached to the folding frame members in a folded configuration.

15. The trampoline of claim 14, wherein the folding frame assembly includes a plurality of peripheral folding frame members and a plurality of folding legs connected to the folding frame assembly, the plurality of folding legs configured to fold while attached to the peripheral folding frame members; and wherein in an unfolded configuration, the adjustable tension system is lifted from a ground position by the plurality of folding legs and in a folded configuration, the adjustable tension system serves as support for the folding frame assembly.

16. The trampoline of claim 15, wherein the plurality of folding legs are each connected to the folding frame assembly by a hinge.

17. A trampoline, comprising:

a trampoline mat;

a plurality of springs attached to the trampoline mat;

a folding frame assembly configured to support the trampoline mat using the plurality of springs, wherein the folding frame assembly includes:

a first peripheral folding frame member and a second peripheral folding frame member; and an adjustable tension system that includes a first connecting member and a second connecting member, wherein the adjustable tension system is configured to slidably move the first connecting member with respect to the second connecting member to decrease a circumference of the folding frame assembly such that the adjustable tension system decreases a tension of the plurality of springs and wherein the adjustable tension system is configured to slidably move the first connecting member with respect to the second connecting member to increase a circumference of the folding frame assembly such that the adjustable tension system increases a tension of the plurality of springs, wherein the first peripheral folding frame member and the second peripheral folding frame member are configured to fold with respect to the adjustable tension system.

18. The trampoline of claim 17, wherein the first connecting member includes an adjustable portion configured to slidably move into the second connecting member and decrease the circumference of the folding frame assembly when a first force is applied to the adjustable tension system; and wherein the adjustable portion slides further from the second connecting member and increases the circumference of the folding frame assembly when a second force is applied to the adjustable tension system.

19. The trampoline of claim 18, wherein the adjustable tension system may be adjusted when the trampoline is in use to configure a plurality of different circumferences of the folding frame assembly, such that the plurality of springs may have a plurality of different tension levels when the trampoline is in use.

20. The trampoline of claim 19, wherein the adjustable tension system comprises:

a bolt and nut assembly to slidably attach the first connecting member and the second connecting member, wherein the bolt and nut assembly includes:

a bolt fixedly attached to the second connecting member; and a bolt head structure fixedly attached to the first connecting member, wherein the bolt head structure rotatably secures the bolt to the first connecting member using an adjusting nut.

* * * * *